US007482993B2

(12) United States Patent
Fujishima et al.

(10) Patent No.: US 7,482,993 B2
(45) Date of Patent: Jan. 27, 2009

(54) VARIABLE-DIRECTIVITY ANTENNA

(75) Inventors: Tomoyasu Fujishima, Osaka (JP); Kazuyuki Sakiyama, Osaka (JP); Ushio Sangawa, Nara (JP); Hiroshi Kanno, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/143,424

(22) Filed: Jun. 20, 2008

(65) Prior Publication Data

US 2008/0246684 A1 Oct. 9, 2008

Related U.S. Application Data

(63) Continuation of application No. PCT/JP2006/324760, filed on Dec. 12, 2006.

(51) Int. Cl.
*H01Q 3/24* (2006.01)

(52) U.S. Cl. ..... 343/876; 343/833; 343/834

(58) Field of Classification Search ..... 343/876, 343/833, 834, 810, 814, 815, 819
See application file for complete search history.

(56) References Cited

U.S. PATENT DOCUMENTS

| | | | | |
|---|---|---|---|---|
| 2,283,081 | A | 5/1942 | Metschl | |
| 3,560,978 | A | 2/1971 | Himmel | |
| 4,700,197 | A * | 10/1987 | Milne | 343/837 |
| 5,235,343 | A | 8/1993 | Audren et al. | |
| 5,541,614 | A | 7/1996 | Lam et al. | |
| 5,767,807 | A * | 6/1998 | Pritchett | 342/374 |
| 6,049,310 | A * | 4/2000 | Sadahiro | 343/702 |
| 6,407,719 | B1 | 6/2002 | Ohira et al. | |
| 6,515,635 | B2 * | 2/2003 | Chiang et al. | 343/834 |
| 7,002,527 | B2 * | 2/2006 | Sugawara | 343/750 |
| 7,193,574 | B2 * | 3/2007 | Chiang et al. | 343/757 |
| 7,202,835 | B2 * | 4/2007 | Chiang et al. | 343/834 |
| 2001/0005181 | A1 | 6/2001 | Desclos et al. | |

FOREIGN PATENT DOCUMENTS

| | | |
|---|---|---|
| EP | 1 753 082 A1 | 2/2007 |
| JP | 49-32239 | 8/1974 |
| JP | 57-073504 | 5/1982 |

(Continued)

*Primary Examiner*—Hoang V Nguyen
(74) *Attorney, Agent, or Firm*—McDermott Will & Emery LLP

(57) ABSTRACT

A variable-directivity antenna according to the present invention includes at least three linear passive elements, which are arranged parallel to a Z-axis so as to surround a feed element. Each of those passive elements includes at least two element pieces, etc. that are arranged parallel to the Z-axis and switching elements, etc. of a first type. The passive element assembly further includes at least one switching element, etc. of a second type that makes two adjacent passive elements electrically continuous with each other when turned ON but electrically insulates them from each other when turned OFF. By turning ON and OFF the at least one switching element of the first type and the at least one switching element of the second type, the antenna can change its directivities. As a result, a linear variable-directivity antenna, which can change its radiation directivities within a vertical plane and of which the overall length in the longitudinal (or major-axis) direction does not increase excessively due to the presence of the passive elements, is realized.

12 Claims, 15 Drawing Sheets

FOREIGN PATENT DOCUMENTS

| | | | |
|---|---|---|---|
| JP | 5-160630 | | 6/1993 |
| JP | 2001-024431 | | 1/2001 |
| JP | 2001-127540 | | 5/2001 |
| JP | 2001-185947 | | 7/2001 |
| JP | 2002-176314 | | 6/2002 |
| JP | 2002-261532 | | 9/2002 |
| JP | 3491682 | | 11/2003 |
| JP | 2004-320682 | | 11/2004 |
| JP | 2005-012779 | | 1/2005 |
| JP | 2005-110231 | | 4/2005 |
| JP | 2005-509345 | | 4/2005 |
| JP | 2005-210564 | | 8/2005 |
| JP | 2005-333555 | | 12/2005 |
| JP | 2005-340910 | | 12/2005 |
| WO | WO 03/041224 | A1 | 5/2003 |
| WO | WO 2005/112194 | A1 | 11/2005 |

* cited by examiner

FIG.6A
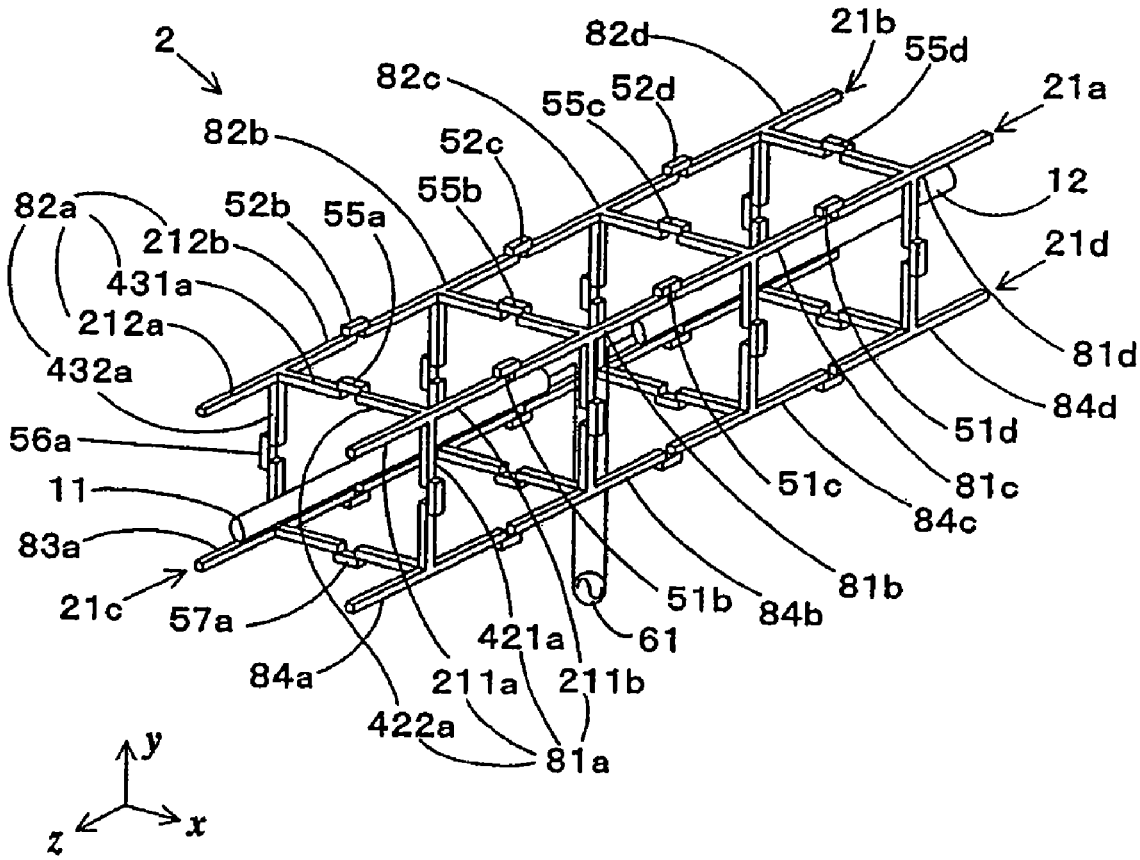
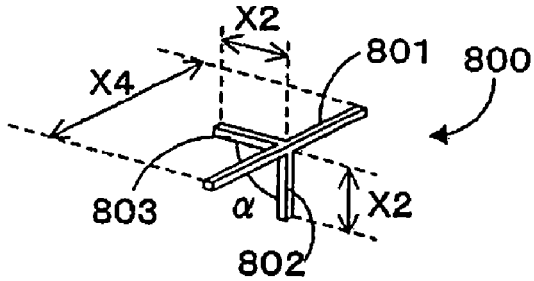
FIG.6B

FIG.9A
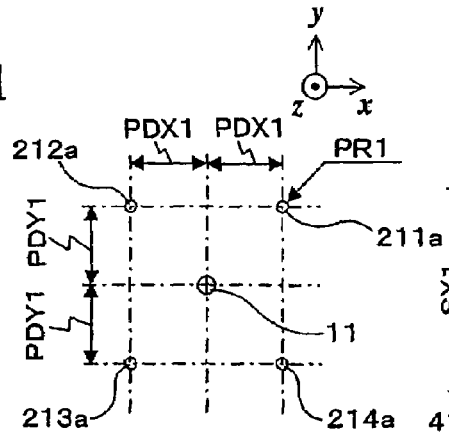
FIG.9B
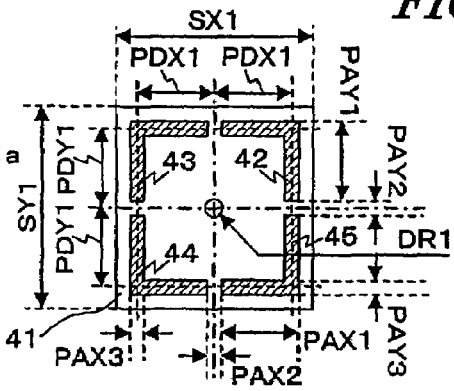
FIG.9C
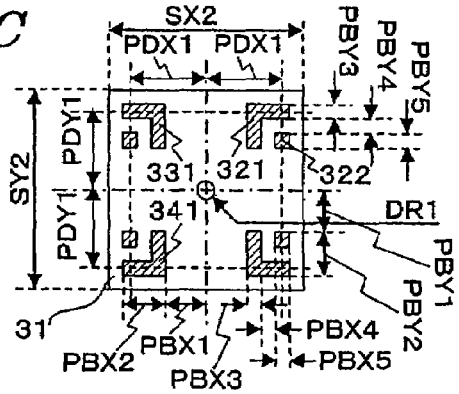
FIG.9D
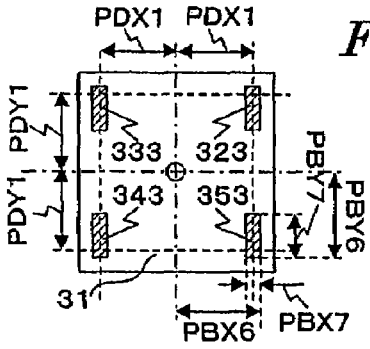
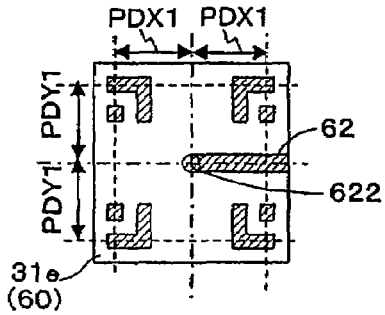
FIG.9E FIG.12A
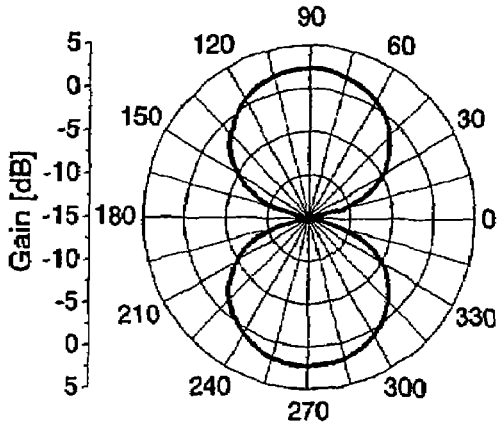
FIG.12B
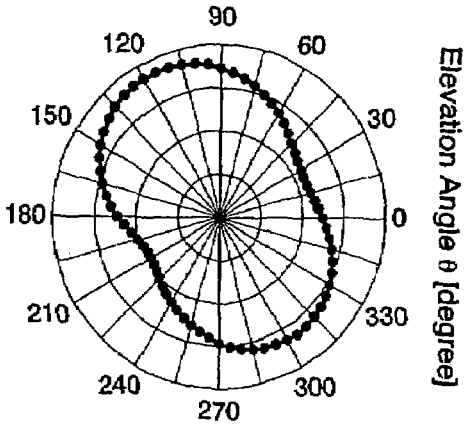
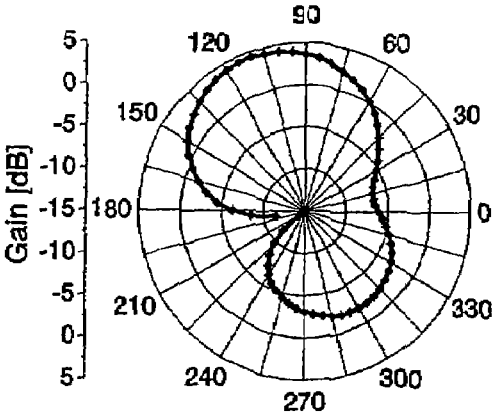
FIG.12C
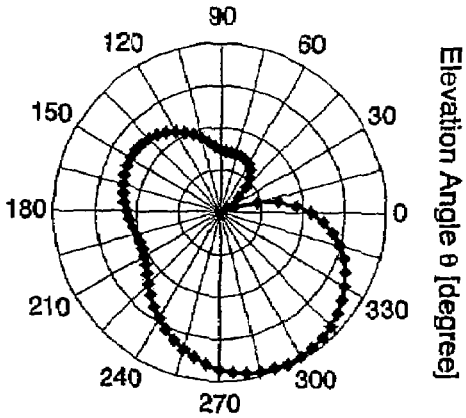
FIG.12D
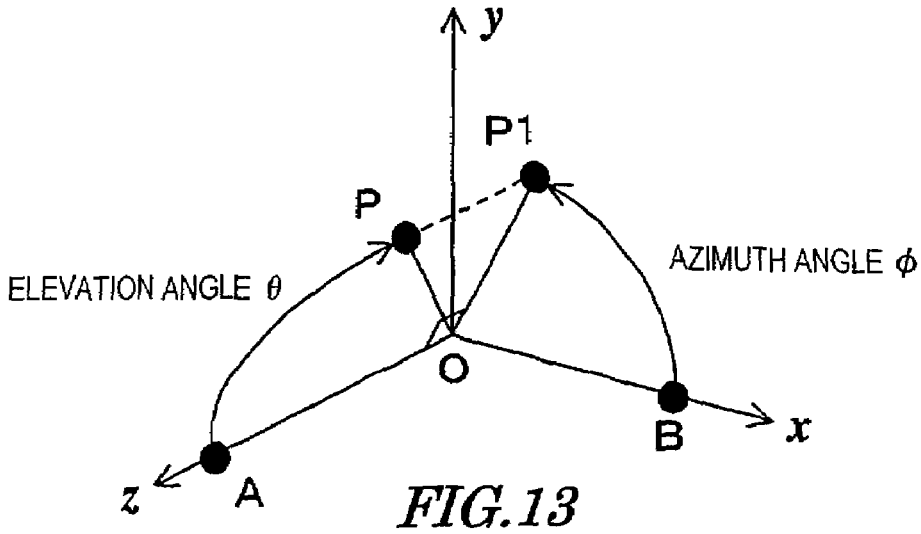
FIG.13

FIG.16A
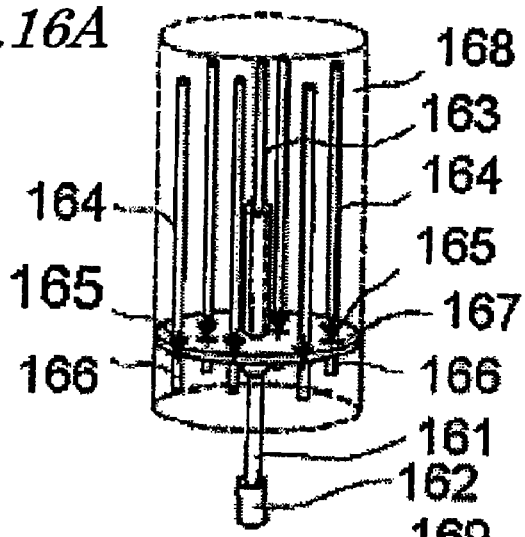
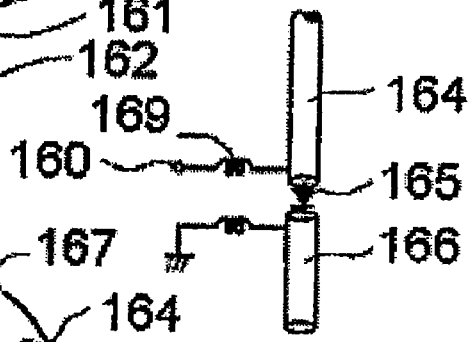
FIG.16B
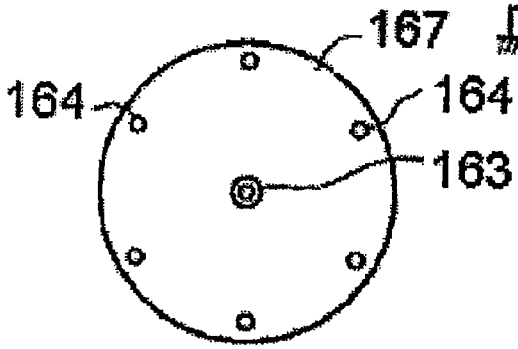
FIG.16C

VARIABLE-DIRECTIVITY ANTENNA

This is a continuation of International Application No. PCT/JP2006/324760, with an international filing date of Dec. 12, 2006, which claims priority of Japanese Patent Application No. 2005-367695, filed on Dec. 21, 2005, the contents of which are hereby incorporated by reference.

BACKGROUND OF THE INVENTION

1. Field of the Invention

The present invention relates to a variable-directivity antenna for use in a device that uses radio frequency electromagnetic waves such as microwaves or millimeter waves.

2. Description of the Related Art

A linear antenna such as a whip antenna for a cellphone is usually designed so as to stand up perpendicularly to the ground when the terminal is used with its body made to stand up to make a call. In that case, the linear antenna has directivity that is isotropic within a horizontal plane, which is defined perpendicularly to its linear feed conductor as shown in FIG. 14. As illustrated in FIG. 14, the terminal 1021 that now stands up perpendicularly to the ground has an antenna radiation directivity pattern 1031 that is parallel to the ground (or a horizontal plane), thus obtaining radiation gains in a broad range. As a result, this terminal 1021 can be used conveniently to access the base station 1001.

When a cellphone is used as an information transmitter-receiver, however, the terminal is often laid down on a desk or something parallel to the ground. In that case, the feed conductor of the linear antenna of such a laid terminal 1022 runs almost horizontally and the direction in which radiation gain is obtained gets tilted with respect to the horizontal plane. As a result, no radiation gains could be obtained in the direction leading to the base station 1001 and the communication sensitivity might decline.

To overcome such a problem, a radiation directivity pattern 1003 in which the radiation directivity of the antenna is varied on a plane including the longitudinal direction of the antenna (i.e., a vertical plane) would be needed.

As for a wireless LAN that is used indoors in most cases, however, the radio waves could sometimes be jammed by comings and goings of people or it could be difficult in some places to establish a communication link due to multi-path phasing. This tendency manifests itself particularly when the frequencies for use to keep up communications increase because the diffraction of electromagnetic waves weakens in that case. That is why this would pose a serious problem when communication systems that use higher frequencies are popularized.

One of the methods for overcoming those problems is a technique for increasing the radiation gain of an antenna in a direction in which a communication link can be established by directly receiving an incoming wave but decreasing the gain in a direction from which a disturbance wave is coming, thereby suppressing interference and increasing the communication sensitivity. For that purpose, an antenna that can change its radiation directivities adaptively according to the status of radio wave propagation is needed.

Meanwhile, an antenna that uses a linear conductor such as a monopole antenna or a dipole antenna has a radiation directivity pattern that is symmetrical with respect to its rotation axis (that runs in the longitudinal direction). A lot of people have proposed an antenna that changes its directivities within a horizontal plane by using an antenna of that type and a passive conductor element in combination. Such an antenna is disclosed in Japanese Patent Application Laid-Open Publication No. 2001-024431, for example.

In such an antenna, however, a gap corresponding to a quarter to a half wavelength needs to be provided between a feed element and a passive element, which is provided outside of the feed element, to optimize the degree of coupling between these two elements. Consequently, the overall antenna will often occupy much space.

A technique for overcoming such a problem is disclosed in Japanese Patent Application Laid-Open Publication No. 2001-127540 (Hereinafter, Patent Document No. 2), for example. Such a technique will be described with reference to FIG. 16. As shown in FIG. 16, the antenna disclosed in that patent document includes not only a linear feed conductor element 163 but also at least two more linear conductors 164 and 166 with mutually different lengths, which are arranged so as to draw a circle around the feed conductor element 163. And those additional linear conductors 164 and 166 are connected together by way of switching elements 165. The antenna further includes members 169 and 160 that are used to connect the antenna to a control section that drives the switching elements 165. And the control section includes a member for driving and turning ON or OFF an arbitrary one of those switching elements.

According to Patent Document No. 2, if a predetermined length is defined by switching those linear passive conductor elements to make those elements function as a waveguide, then the radiation directivity can be established in the direction in which the waveguide is defined and the radiation characteristic can be controlled within a horizontal plane.

In addition, linear passive conductors that are not used may be switched so as to have lengths that do not affect a predetermined electromagnetic wave. That is why the linear passive conductors can be arranged near the feed conductor element and the space occupied by the antenna around the feed conductor element can be cut down.

Suppose such an antenna is used in a mobile telecommunications terminal such as a cellphone. In that case, even if the user holding the cellphone has changed his or her posture or if the communication status has changed, the gain of the antenna could be increased and the communication sensitivity could be improved by controlling the radiation directivity.

According to the technique disclosed in Patent Document No. 2, however, the radiation directivity can be controlled only within a horizontal plane, not within a vertical plane. To change the radiation directivities within a vertical plane, an array may be formed by arranging a number of feed elements in their longitudinal direction (such an array is called a "collinear array") and the phases may be controlled between those elements. Such a technique is disclosed in Japanese Patent Application Laid-Open Publication No. 05-160630 (Hereinafter, Patent Document No. 3), for example. Hereinafter, the technique disclosed in Patent Document No. 3 will be described with reference to FIG. 18.

The antenna shown in FIG. 18 has two cylindrical conductors 189 and 180, multiple pairs of half-wave dipole antenna elements 183 and a coaxial feeder line 184. The cylindrical conductors 189 and 180 are arranged concentrically with a dielectric member 181 interposed between them. A number of ring slots 182 are arranged periodically on the outer one 189 of the two cylindrical conductors 189 and 180 at an interval of less than 0.7 wavelength. Each pair of half-wave dipole antenna elements 183 is arranged symmetrically around, and interposes, an associated one of the ring slots 182 and implemented as cylindrical skirts. The coaxial feeder line 184 is arranged so as to extend inside the inner one 180 of the two cylindrical conductors 189 and 180. And the coaxial feeder line 184 has an outer conductor and an inner conductor that are respectively electrically continuous with the outer and inner ones 189 and 180 of the two cylindrical conductors.

By arranging those ring slots 182 periodically, each pair of adjacent antenna elements 183 is supplied with electricity so as to have a predetermined phase difference between them. As a result, beam tilting is realized on the vertical plane.

According to the technique disclosed in Patent Document No. 3, however, the radiation directivity cannot be controlled within a horizontal plane. In addition, since a number of antenna elements are arranged vertically in multiple stages, the antenna assembly becomes longer and longer as the number of such stages increases. For that reason, this technique is not effectively applicable to a mobile telecommunications terminal that should have as small a size as possible.

A technique for overcoming such a problem is disclosed in Japanese Patent No. 3491682 (Hereinafter, Patent Document No. 4), for example. The antenna disclosed in that patent document will be described with reference to FIG. 17. The antenna includes a linear radiator (feed element) 170, at least one linear passive element 173, and a U-passive element 171. The linear passive element(s) 173 is/are arranged parallel to the feed element 170 so as to keep a predetermined distance from the feed element 170. If there is only one linear passive element 173, its length may be half as long as a desired transmission frequency. On the other hand, if there are multiple linear passive elements 173, those elements 173 are connected together with switches 172 interposed between them. The U-passive element 171 is arranged near one end of the linear radiator 170 and has two arm portions that are parallel to each other. When viewed on a plane that intersects at right angles with the plane including the two arm portions, the U-passive element 171 is arranged such that one end of the linear radiator 170 is inserted between the two arm portions through the end of the two arm portions.

According to the technique disclosed in Patent Document No. 4, the linear passive element 173 is divided into a number of portions that should be connected together with the switches 172 interposed between them, thereby changing the locations of the passive elements that need to interact with the feed element on both vertical and horizontal planes.

As a result, the radiation directivities can be changed on the vertical plane, too. It should be noted that the U-passive element 171 is provided just to achieve matching and essentially has nothing to do with the control of radiation directivity, which is the problem to be solved by the present invention.

As disclosed in Patent Document No. 4, the passive element used as a reflector should have a length corresponding to approximately a half wavelength. Likewise, the passive elements that are used to form a waveguide should also have a length substantially corresponding to at least a half wavelength to be arranged near the feed element.

To change radiation directivities within the vertical plane, the center of the passive element that needs to function as either a waveguide or a reflector should be shifted in the longitudinal direction (or major-axis direction) with respect to the center of the feed element. That is to say, the center of the passive element should be shifted perpendicularly to the horizontal plane. An example of such design is shown in FIG. 15.

The length L2 of a straight passive element 20 is approximately equal to the combined length D2 of a pair of feed elements 10. To change the radiation directivities in an elevation angle direction on the vertical plane, the center of the straight passive element 20 should be shifted in the longitudinal direction of the pair of feed elements 10. In FIG. 15, this length is identified by L1.

However, the overall length of the antenna should be increased by the magnitudes of shifts of these two centers. Consequently, the antenna will occupy too much space to be used in a mobile telecommunications terminal that should have as small a size as possible.

In order to overcome the problems described above, the present invention has an object of providing an antenna assembly that can control the radiation directivity of a linear antenna such as a dipole antenna on not only the plane including its feed element (i.e., vertical plane) but also the plane intersecting with the feed element at right angles (i.e., horizontal plane) and that does not have its overall antenna length increased by its passive element in the longitudinal (i.e., major-axis) direction.

SUMMARY OF THE INVENTION

A variable-directivity antenna (1) according to the present invention includes feed elements (11, 12), which are implemented as linear conductors running parallel to a Z-axis, and a passive element assembly (2). The passive element assembly (2) includes a number n (where n is a natural number that is equal to or greater than three) of passive elements (21*a*, 21*b*, 21*c* and 21*d*) that also run parallel to the Z-axis so as to surround the feed elements (11, 12). Each said passive element (21*a*, 21*b*, 21*c* or 21*d*) includes: a plurality of element pieces (211*a* through 211*h*, 212*a* through 212*h*, 213*a* through 213*h* or 214*a* through 214*h*) that are arranged parallel to the Z-axis; and at least one switching element of a first type (51, 52, 53, 54) that electrically connects selected ones of the element pieces (211*a* through 211*h*, 212*a* through 212*h*, 213*a* through 213*h* or 214*a* through 214*h*) to each other. The passive element assembly (2) further includes at least one switching element of a second type (55, 56, 57, 58) that electrically connects two adjacent ones of the n passive elements (21*a*, 21*b*, 21*c* and 21*d*) to each other when turned ON but electrically disconnects the two adjacent passive elements from each other when turned OFF. The variable-directivity antenna (1) changes its directivities by turning ON and OFF the at least one switching element of the first type (51, 52, 53, 54) and the at least one switching element of the second type (55, 56, 57, 58).

In one preferred embodiment, a distance from the passive elements (21*a*, 21*b*, 21*c*, 21*d*) to the feed elements (11, 12) is equal to or shorter than one quarter of the wavelength of electromagnetic waves to radiate.

In another preferred embodiment, each said passive element (21*a*, 21*b*, 21*c*, 21*d*) is shorter in length than the feed elements (10).

In still another preferred embodiment, the passive element assembly (2) further includes planar substrates (31, 41) on which the switching element(s) of the first type (51, 52, 53, 54) and/or the switching element(s) of the second type (55, 56, 57, 58) are/is mounted. The planar substrates (31, 41) are held by the feed elements (11, 12).

A variable-directivity antenna according to the present invention can change its radiation directivities into any desired direction both on a plane including the longitudinal direction of its feed element (i.e., a "vertical plane") and on a plane that intersects with the feed element at right angles (i.e., a "horizontal plane") without increasing its size in the longitudinal (or major-axis) direction excessively due to the presence of the passive element.

BRIEF DESCRIPTION OF DRAWINGS

FIG. 6A is a perspective view illustrating a principle configuration, including conductor portions and switches, for the variable-directivity antenna of the preferred embodiment shown in FIG. 1, and FIG. 6B is a perspective view illustrating a passive unit element thereof.

FIG. 9A is a cross-sectional view of the variable-directivity antenna shown in FIG. 8 as viewed on a plane that intersects with the Z-axis at right angles and FIGS. 9B through 9E illustrate conductor patterns on respective planar substrates thereof.

FIGS. 12A through 12D show radiation directivity gain patterns for the respective designs of the passive element shown in FIG. 10 in the specific example of the variable-directivity antenna of the present invention.

FIG. 13 is a schematic representation defining an orthogonal coordinate system, an azimuth angle and an elevation angle.

FIGS. 16A through 16C illustrates a conventional sector antenna of a switching type.

DETAILED DESCRIPTION OF PREFERRED EMBODIMENTS

Figure 1:
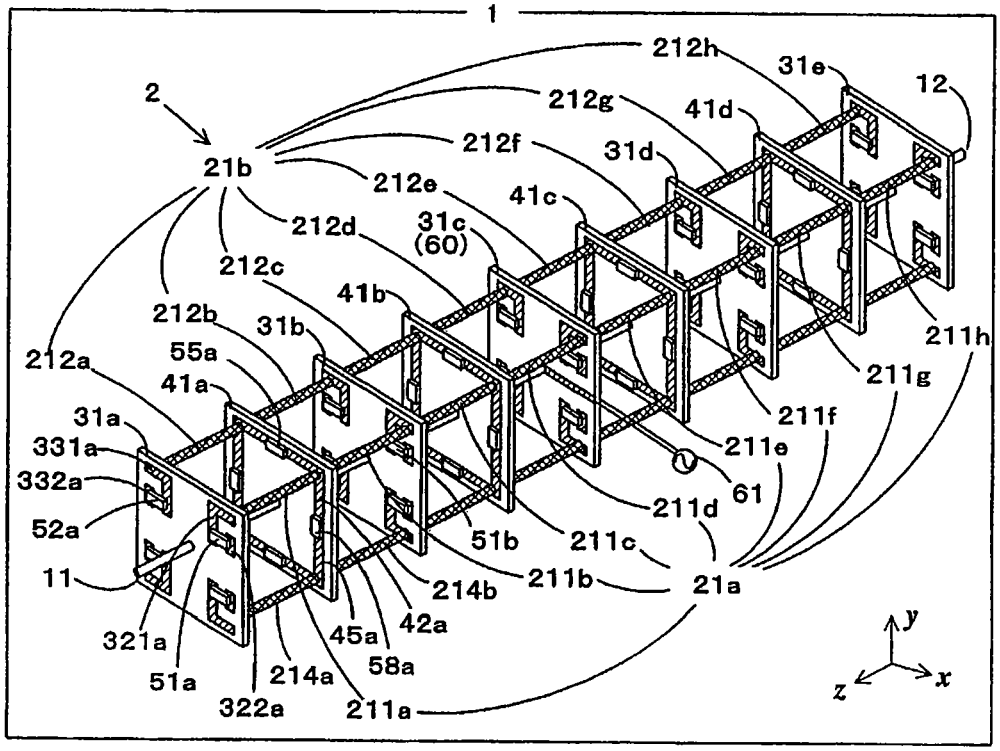
FIG. 1 is a perspective view illustrating a variable-directivity antenna as a preferred embodiment of the present invention.

Hereinafter, preferred embodiments of the present invention will be described with reference to the accompanying drawings.

In the following description, "coupling", "connection" and "continuity" will be used herein as terms with mutually different meanings. Specifically, if two elements are "coupled" together, those two elements are electromagnetically coupled together. That is to say, although the two elements exchange energy between them, they are not physically continuous with each other. On the other hand, if two elements are "connected" together, they are physically continuous with each other, unless the term is used in combination with any other particular adjective. Nevertheless, "electrical connection" and "continuity" could be used in the same meaning. If two elements are "continuous" with each other, direct current can flow between those two elements. Thus, "continuous" is synonymous with "short-circuited" or "electrically connected".

Embodiment

Hereinafter, a preferred embodiment of the present invention will be described with reference to FIGS. 1 and 2.

First of all, FIG. 13 shows a relation between the XYZ coordinate system, the elevation angle θ and the azimuth angle ϕ that will be used in this description. If there is an arbitrary point P in a three-dimensional space, the direction from the origin O to that point P can be represented as follows using the elevation angle θ and the azimuth angle ϕ.

If another arbitrary point A is set in the positive direction on the Z-axis, the elevation angle θ is defined as the angle P-O-A. On the other hand, if a point P1 is set by orthogonally projecting the point P onto the XY plane and if still another arbitrary point B is set in the positive direction on the X-axis with respect to the origin O, the azimuth angle ϕ is defined as the angle P1-O-B counterclockwise around the origin O and with respect to the point B as viewed from the positive direction on the Z-axis.

In this description, the longitudinal (or major-axis) direction of the antenna is supposed to be the Z-axis. Therefore, the elevation angle θ corresponds to an angle measured from the positive direction on the Z-axis on a plane including the longitudinal (or major-axis) direction of the antenna (such a plane will be referred to herein as a "vertical plane"). On the other hand, the azimuth angle ϕ corresponds to an angle measured from the positive direction on the X-axis on a plane that intersects at right angles with the plane including the longitudinal (or major-axis) direction of the antenna (the former plane will be referred to herein as a "horizontal plane").

In this description, a small letter a, b, c, d, etc. is added to some reference numerals such as "element piece 211*a*". These small letters are used to clearly identify the respective pieces that will form a single integral member performing a certain intended function when assembled together. On the other hand, a reference numeral with no small letters such as "element piece 211" identifies a group of those pieces that have been assembled together to form a single integral member.

FIG. 1 is a perspective view illustrating a variable-directivity antenna 1 (which will be sometimes simply referred to herein as an "antenna" 1), which is assembled by stacking multiple substrates one upon the other.

The variable-directivity antenna 1 of this preferred embodiment includes a feed element pair 10 and a passive element assembly 2.

The feed element pair 10 functions as a single dipole antenna consisting of a pair of feed elements 11 and 12, which are linear or bar conductors that run through the center of the antenna. In this preferred embodiment, both of these feed elements 11 and 12 are arranged on the Z-axis.

The passive element assembly 2 includes a passive element body 21 consisting of bar conductors (which will also be referred to herein as "passive elements") that run parallel to the feed element pair 10 and first and second types of planar substrates 31 and 41, which are arranged such that a normal to their principal surface becomes parallel to the feed element pair 10.

The passive element body 21 consists of four bar conductors 21*a* through 21*d*, which are arranged parallel to the Z-axis and which are electrically insulated from each other. These four bar conductors 21*a* through 21*d* are arranged so as to surround the feed element pair 10 altogether. Each bar conductor 21 is divided by the first and second types of planar substrates 31 and 41 into a number of shorter bar conductor pieces (which will be referred to herein as "element pieces"). Specifically, the passive element 21*a* consists of element pieces 211*a*, 211*b*, . . . and 211*h*, and the passive element 21*b* consists of element pieces 212*a*, 212*b*, . . . and 212*h*. Likewise, the two other passive elements 21*c* and 21*d* also consist of multiple element pieces just like these passive elements 21*a* and 21*b*.

The passive element assembly 2 of this preferred embodiment includes five planar substrates 31*a* through 31*e* of the first type that are arranged such that a normal to their principal surface is parallel to the Z-axis. Also, the passive element assembly 2 of this preferred embodiment further includes four planar substrates 41*a* through 41*d* of the second type that are arranged such that a normal to their principal surface is parallel to the Z-axis. On each of the planar substrates 31 of the first type, arranged are conductor patterns 321 to 352 and switches 51 to 54. On each of the planar substrates 41 of the second type, arranged are conductor patterns 42 to 45 and switches 55 to 58.

The feed elements 11 and 12 run through the center of these first and second types of planar substrates 31 and 41 one after another. These planar substrates 31 and 41 of the first and second types are arranged so as not to make direct contact with each other but be spaced from each other along the feed element pair 10.

In the example illustrated in FIG. 1, the first and second types of planar substrates 31 and 41 are arranged alternately along the feed element pair 10. However, these two types of planar substrates do not necessarily have to be arranged alternately. Alternatively, a number of planar substrates 31 of the first type may be arranged consecutively without interposing any planar substrate 41 of the second type between them. Also, in FIG. 1, the first and second types of planar substrates 31 and 41 are illustrated as being arranged at regular intervals. However, the interval between the planar substrates 31 and 41 does not have to be regular. Besides, the number of the planar substrates 31 of the first type and that of the planar substrates 41 of the second type do not have to be five and four, either, as shown in FIG. 1.

Figure 2A:
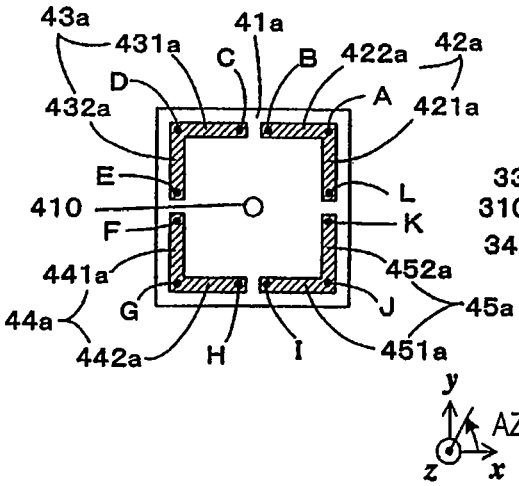
FIGS. 2A and 2B are plan views illustrating planar substrates for use in the variable-directivity antenna of the preferred embodiment shown in FIG. 1.
Figure 2B:
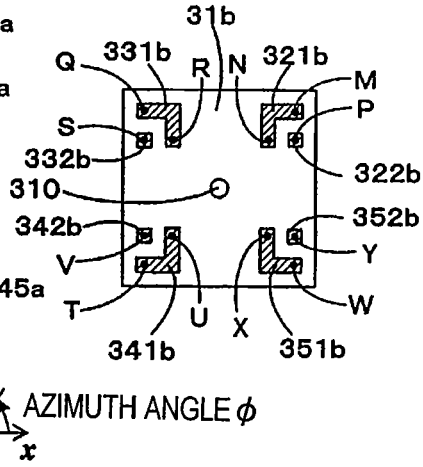

FIGS. 2A and 2B illustrate the layouts of the planar substrates 41 and 31 of the second and first types, respectively. Each planar substrate 31 of the first type has the same pattern of conductors as any other planar substrate 31 of the same type. And each planar substrate 41 of the second type also has the same pattern of conductors as any other planar substrate 41 of the same type. That is why FIG. 2 illustrates the conductor patterns of the planar substrates 31*b* and 41*b* that represent those two types.

The planar substrate 41 of the second type shown in FIG. 2A has a square planar shape and has its center aligned with the Z-axis. The four sides of the square are parallel to either the X-axis or the Y-axis. On the planar substrate 41 of the second type, four L-conductor patterns 42 through 45 are arranged at the four corners of the square and a through hole 410 has been cut to pass the feed element pair. More specifically, the conductor pattern 42 located at an azimuth angle of 45 degrees forms an L shape by connecting a strip conductor pattern portion 422 parallel to the X-axis and another strip conductor pattern portion 421 parallel to the Y-axis together such that those two conductor pattern portions are joined together at the point A, which is located at one of the two ends thereof that is closer to an associated one of the four vertices of the planar substrate.

This L-conductor pattern 42 is located on a plane that intersects with the passive element body 21 at right angles and gets electrically continuous with the passive element 21*a* and is used as a part of the passive element assembly 2 as will be described later. As can be seen, as the L-conductor pattern 42 has branched from the passive element body 21, the conductor pattern 42 will be referred to herein as a "branched element portion of the passive element assembly 2" (or simply referred to herein as a "branched element portion").

Likewise, the conductor pattern 43 located at an azimuth angle of 135 degrees forms an L shape by connecting a strip conductor pattern portion 431 parallel to the X-axis and another strip conductor pattern portion 432 parallel to the Y-axis together such that those two conductor pattern portions are joined together at the point D, which is located at one of the two ends thereof that is closer to an associated one of the four vertices of the planar substrate.

The conductor patterns 422 and 431, which function as branched element portions, are electrically insulated from each other with a certain gap, which is much shorter than the wavelength of the electromagnetic wave to radiate, left between them. The two ends of that gap, i.e., one end in contact with the conductor pattern 422 at a point B and the other end in contact with the conductor pattern 431 at a point C, are connected together with a switch 55 as shown in FIG. 1.

Likewise, the conductor pattern 44 located at an azimuth angle of 225 degrees forms an L shape by connecting a strip conductor pattern portion 442 parallel to the X-axis and another strip conductor pattern portion 441 parallel to the Y-axis together such that those two conductor pattern portions are joined together at the point G, which is located at one of the two ends thereof that is closer to an associated one of the four vertices of the planar substrate. In the same way, the conductor pattern 45 located at an azimuth angle of 315 degrees forms an L shape by connecting a strip conductor pattern portion 451 parallel to the X-axis and another strip conductor pattern portion 452 parallel to the Y-axis together such that those two conductor pattern portions are joined together at the point J, which is located at one of the two ends thereof that is closer to an associated one of the four vertices of the planar substrate.

The conductor patterns 441, 442 and 451, 452 are electrically insulated from each other with a certain gap, which is much shorter than the wavelength of the electromagnetic wave to radiate, left between them. The two ends of that gap are connected together with a switch (the reference numeral of which is not shown in FIG. 1).

Next, the conductor patterns for the planar substrate 31 of the first type shown in FIG. 2B will be described. The planar substrate 31 of the first type has the same shape and same dimensions as the planar substrate 41 of the second type and also has its center aligned with the Z-axis. Around a through hole 310 to pass the feed element pair 10, four conductor patterns are located at azimuth angles of 45, 135, 225 and 315 degrees, respectively. These conductor patterns are mirror-symmetric to each other with respect to the X- and Y-axes. That is why only the shape of the conductor pattern located at an azimuth angle of 45 degrees will be described here.

At an azimuth angle of 45 degrees, there are two conductor patterns 321 and 322, which are electrically insulated from each other. These conductor patterns 321 and 322 are provided so as to make the element pieces 211, which form a bar conductor that connects the planar substrates 31 and 41 together, electrically continuous with each other with a switch turned. For example, as for the planar substrate 31*b*, the element pieces 211*b* and 211*c* are electrically connected together with the switch 51*b* closed.

One of the two ends of the conductor pattern 321*b* is located at a point M in the vicinity of an associated vertex of the substrate 31*b*. And the conductor pattern 321*b* is connected to the element piece 211*b* at that point M. The other end of the conductor pattern 321*b* is located at a point N. If a point p is set on the conductor pattern 322, the points P and N are connected together with the switch 51*b* as shown in FIG. 1. Those conductor patterns on the planar substrate 31, such as the conductor patterns 321 and 322, are provided to operate a switch. Unless the loss increases, their dimensions are preferably much smaller than the wavelength.

The conductor patterns on each of these two types of planar substrates 31 and 41 do not make electrical contact with the feed element pair 10. However, the planar substrates 31 and 41 of the first and second types do make structural contact with the feed element pair 10. More specifically, through holes 310 and 410 to pass the feed element pair 10 are located at the center of the planar substrates 31 and 41. By fitting the feed element pair 10 into these through holes 310 and 410, the planar substrates 31 and 41 are fixed. As a result, the positions and directions of the planar substrates 31 and 41 with respect to the feed element pair 10, the gap between these planar substrates 31 and 41 and their directions are determined.

In this preferred embodiment, the through holes 310 and 410 are located inside a polygon (e.g., square in this example) defined by the branched element portions 42, 43, 44 and 45 of the passive element assembly 2, and pass the feed element pair 10 as described above, thereby fixing the feed element pair 10 with respect to the planar substrates 31 and 41.

Also, in this preferred embodiment, the planar substrates 31 and 41 are arranged at regular intervals along the feed element pair 10. Also, these planar substrates 31 and 41 are arranged such that each of the four corners of the planar substrates 31 of the first type and an associated corner of the planar substrates 41 of the second type face the same direction. Specifically, in the example described above, each pair of corners of the planar substrates 31 and 41 of the first and second types is located at an azimuth angle of 45, 135, 225 or 315 degrees.

Hereinafter, it will be described with reference to FIGS. 3A through 3C how to connect the conductor patterns on the planar substrates 31 and 41 to the passive element body 21.

Figure 3A:
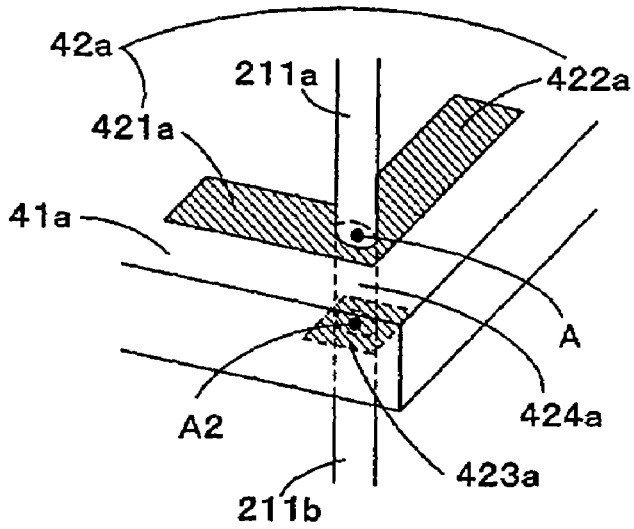
FIGS. 3A through 3C are perspective views illustrating how to connect the element pieces and branched element portions of passive elements together in the variable-directivity antenna of the preferred embodiment shown in FIG. 1.

First, look at FIG. 3A, which is an enlarged perspective view illustrating a portion of the second type of planar substrate 41*a* that is located at an azimuth angle of 45 degrees. The L-conductor pattern 42*a*, functioning as a branched element portion, is arranged on the upper surface of the planar substrate 41*a* of the second type, and another conductor pattern 423*a* is provided on the back surface thereof so as to have a point A2 that is located right under the point A where the L-conductor pattern 42*a* bends.

The element pieces (bar conductors) 211*a* and 211*b* are connected to the planar substrate 41*a* of the second type at the points shown in FIG. 3A. More specifically, the element piece 211*a* is connected to the upper surface of the planar substrate 41*a* at the point A, while the element piece 211*b* is connected to the back surface of the planar substrate 41*a* at the point A2. The second type of planar substrate 41*a* also has a via hole 424*a* that connects these two points A and A2 together inside the substrate. Consequently, the element pieces 211*a* and 211*b*, the conductor patterns 42*a* and 423*a* and the via hole 424*a* are all electrically connected together.

This configuration is electrically equivalent to the passive unit element 800 to be described later with reference to FIG. 6B. That is why the element pieces 211*a* and 211*b* do not have to be two separate members but may be just two portions of a single continuous bar conductor. In that case, a through hole that passes the points A and A2 may be cut through the planar substrate 41*a* and be fitted with the bar conductor to have the bar conductor make electrical contact with the conductor patterns 42*a* and 423*a*. In such a situation, the conductor pattern 423*a* that would function as a conductor pattern to cut a via hole sometimes could be omitted.

Figure 3B:
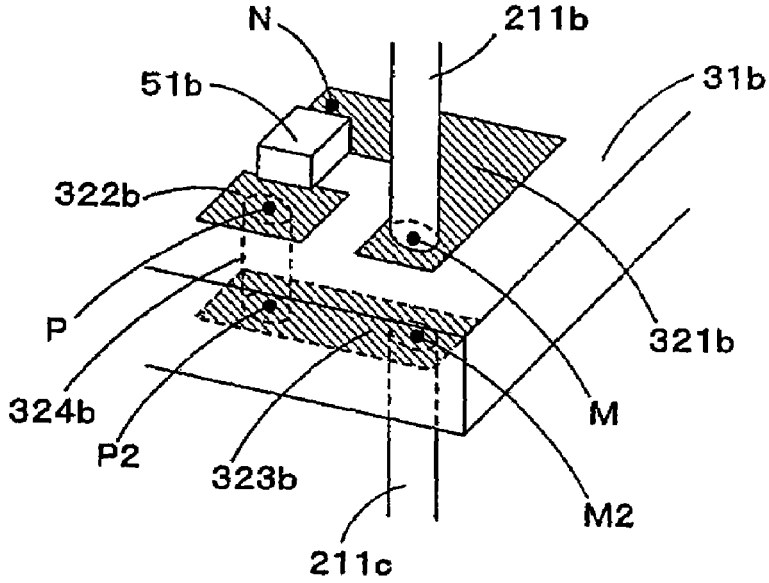

FIG. 3B is an enlarged perspective view illustrating a portion of the first type of planar substrate 31*b* that is located at an azimuth angle of 45 degrees. Two conductor patterns 321*b* and 322*b* are arranged on the upper surface of the planar substrate 31*b* of the first type, and another conductor pattern 323*b* is arranged on the back surface thereof. One end of the conductor pattern 321*b* has the point M that is located in the vicinity of the associated vertex of the planar substrate 31*b* of the first type and the conductor pattern 321*b* is connected to the element piece 211*b* at that point M. The other end of the conductor pattern 321*b*, which is located at the point N, is connected to the conductor pattern 322*b* (including the point P) with the switch 51*b*. The point P on the conductor pattern 322*b* and another point P2, which is located right under the point P and included in the conductor pattern 323*b* on the back surface, are connected together through a via hole 324*b*. The pattern 323*b* on the back surface covers a range that reaches a point M2 (that is located right under the point M) in the vicinity of the vertex of the substrate from the point P2 and is connected to the element piece 211*c* as a bar conductor at that point M2.

When the switch 51*b* is closed, the element pieces 211*b* and 211*c* are electrically continuous with each other. On the other hand, when the switch 51*b* is opened, the element pieces 211*b* and 211*c* are electrically disconnected from each other.

Figure 3C:
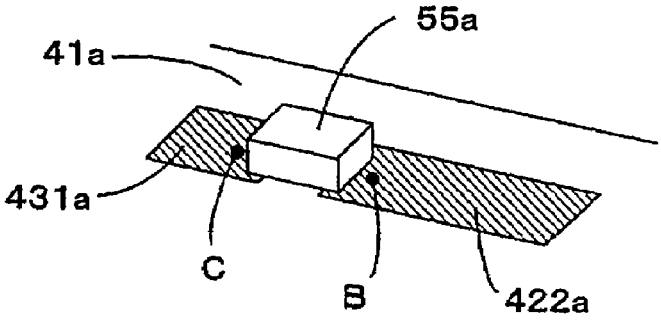

FIG. 3C is an enlarged perspective view illustrating a portion of the second type of planar substrate 41*a* that is located at an azimuth angle of 90 degrees. On the upper surface of the planar substrate 41*a* of the second type, arranged are two conductor patterns 422*a* and 431*a* with their ends (including points B and C) put close to each other, and these two points B and C are connected together with a switch 55*a*. Thus, when the switch 55*a* is closed, the conductor patterns 422*a* and 431*a* are electrically continuous with each other. But when the switch 55*a* is opened, the conductor patterns 422*a* and 431*a* are electrically disconnected from each other.

By arranging these two types of planar substrates 31 and 41 one after another with respect to the feed element pair 10 defining their center axis and by connecting adjacent ones of those planar substrates 31 and 41 together with the element pieces 211, 212, 213 and 214 that are bar conductors, the variable-directivity antenna 1 shown in FIG. 1 is realized.

The planar substrates are preferably made of a low-loss substrate material, which is normally used in an RF circuit. Specifically, the planar substrates may be implemented as glass epoxy resin substrates, ceramic substrates, or semiconductor substrates, to name a few. Meanwhile, the conductor patterns may be formed by subjecting copper, aluminum or any other suitable material to printing, plating or any other appropriate process.

The switches may be either manual switches or semiconductor switches such as PIN diodes or FETs.

Figure 4A:
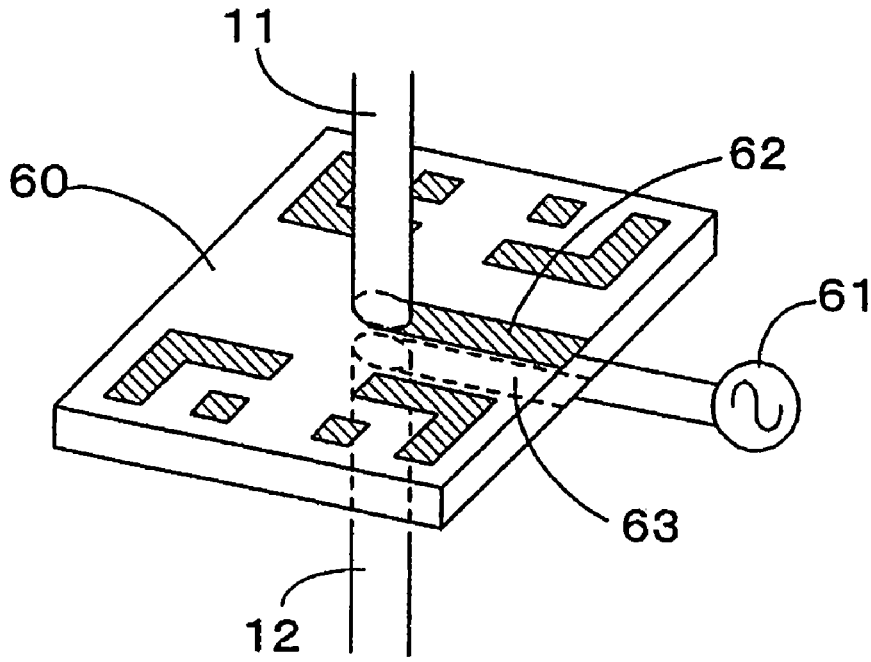
FIGS. 4A and 4B are perspective views illustrating how to feed electric power using a feed substrate in the variable-directivity antenna of the preferred embodiment shown in FIG. 1.

Hereinafter, it will be described with reference to FIG. 4 how to feed power to the antenna of this preferred embodiment. FIG. 4 illustrates a planar substrate 60 that is arranged between the two feed elements 11 and 12. This planar substrate 60 corresponds to the first type of planar substrate 31*c* shown in FIG. 1.

Figure 4B:
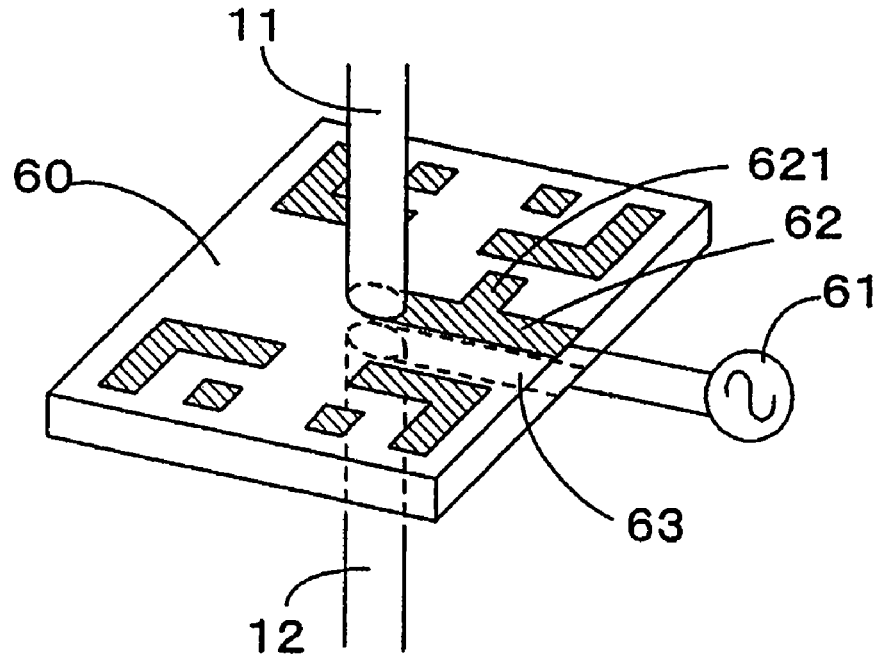

On the upper and lower surfaces of the planar substrate 60, arranged are strip feeder lines 62 and 63 so as to face each other vertically. These feeder lines 62 and 63 run from one edge of the substrate toward its center so as to be connected to the feed elements 11 and 12 at the center of the substrate. At that edge of the planar substrate 60, these feeder lines 62 and 63 are electrically connected to a transceiver 61. Optionally, the matching property of the antenna could be improved by providing a matching stub 621 for the feeder lines 62 and 63 as shown in FIG. 4B.

In the preferred embodiment shown in FIG. 1, the first type of planar substrate 31*c* is used as the feeding planar substrate 60. However, the feeding planar substrate 60 may also be any other planar substrate 31 or 41 or even an additional substrate including only that pair of feeder lines, instead of the first or second type of planar substrate 31 or 41. Also, the dimensions and shape of the feeding planar substrate 60 do not have to be the same as the other planar substrates described above.

Figure 5:
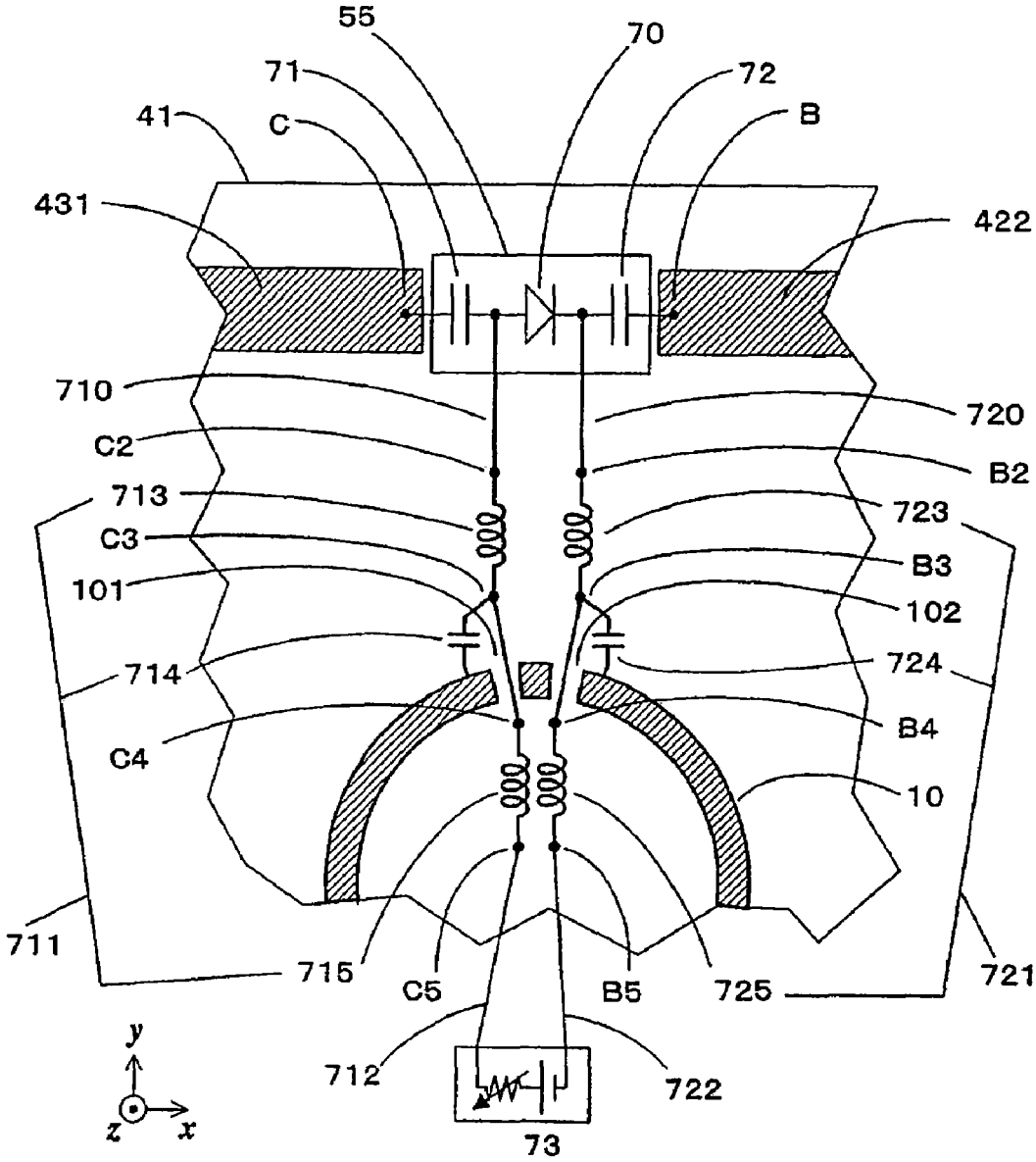
FIG. 5 is a schematic representation illustrating a preferred embodiment of a switch for the variable-directivity antenna of the preferred embodiment shown in FIG. 1.

Next, it will be described more fully with reference to FIG. 5 exactly how to implement the switches shown in FIG. 3. FIG. 5 is a schematic representation of the second type of planar substrate 41 illustrating a detailed implementation of the switch 55.

In the example to be described below, the second type of planar substrate 41 is taken as an example and a PIN diode 70 is supposed to be used as the switch 55 that connects together the branched element portions 422 and 431 provided as conductor patterns. It should be noted, however, that the same statement equally applies to any other planar substrate or a switch at any other location. And that statement also applies to even a situation where a three-terminal element such as an FET is used a switch.

In this preferred embodiment, the feed element pair 10 is a pair of hollow cylindrical conductors and has very small through holes 101 and 102 on their surface. However, the feed element pair 10 does not have to have such a configuration.

In the example illustrated in FIG. 5, the branched element portions 422 and 431 are arranged as conductor patterns on the second type of the planar substrate 41 with their respective ends (including the points B and C) facing each other. Also, the switch 55 is arranged so as to connect together those ends of the branched element portions 422 and 431.

Two control lines 710 and 720 are connected to the switch 55. Each of these two control lines 710 and 720 passes a low pass filter 711 or 721 to reach the inside of the feed element pair 10 and be connected to a DC power supply 73.

The switch 55 includes two capacitors 71 and 72 and a PIN diode 70. Specifically, the one capacitor 71, the PIN diode 70 and the other capacitor 72 are connected in series together between those ends of the branched element portions 422 and 431.

The respective outer terminals of the capacitors 71 and 72 that are located at both ends of the switch 55 are connected to the points B and C of the conductor patterns on the second type of planar substrate 41. The capacitors 71 and 72 are provided to cut off direct current. And the PIN diode 70 is cut off with respect to the branched element portions 422 and 431 so as not to be supplied with direct current.

It should be noted that these points B and C are just symbols representing the ends of the branched element portions 422 and 431. Actual mounting is done by flip-chip bonding, wire bonding or any other appropriate technique.

In the switch 55, the one control line 710 branches halfway from the line that connects the capacitor 71 and the PIN diode 70 together so as to connect the points C2 and C5 together and the other control line 720 branches halfway from the line that connects the capacitor 72 and the PIN diode 70 together so as to connect the points B2 and B5 together. These control lines are implemented as conductor patterns (not shown) on the planar substrate and are connected to their associated terminals of the low pass filters 711 and 721 at the points C2 and B2.

The other terminals of the low pass filters that are located at the points C5 and B5 are connected to control lead wires 712 and 722 that pass the inside of the feed element pair 10. The control lead wires 712 and 722 reach the outside of the feed element pair 10 on the feed substrate 60, for example, and is further connected to the DC power supply 73 at the far end of the substrate 60.

Each of those low pass filters has a T-circuit configuration consisting of two inductors and one capacitor. More specifically, the low pass filter 711 includes an inductor 713 that is connected in series to the switch 55, a capacitor 714 that is connected in parallel to the switch 55, and another inductor 715 connected to the DC power supply 73. The same configuration may be adopted for the low pass filter 721 and the other low pass filters (not shown), and the detailed description thereof will be omitted herein.

As the low pass filter, an EMI filter such as a feedthrough capacitor may be used. The low pass filter may be implemented so as to pass through the through hole 101 of the feed element pair 10. At the through hole 101, the grounded terminal of the parallel capacitor 714 is connected to the feed element pair 10. The diameter of those through holes 101 is supposed to be much smaller than the wavelength of the electromagnetic wave to radiate.

If a feedthrough capacitor with a lead wire is used, then the lead wire itself may be used as an inductor. Also, if the lead wire 712 to pass inside the feed element pair 10 is a line with dielectric property, then the overall control lines leading from the points B2 and C2 as the control line terminals of the switch through the DC power supply may be used as low pass filters. Also, if the feed element pair 101 is designed such that its hollow inside portion functions as a waveguide and that the radiation frequency becomes equal to or lower than the cutoff frequency, then it is possible to prevent the electromagnetic wave radiated from the antenna from propagating through the inside hollow portion of the feed element pair 10.

When such a configuration is adopted, the switch 55 can be opened and closed by operating the external DC power supply 73 shown in FIG. 5.

Figure 7A:
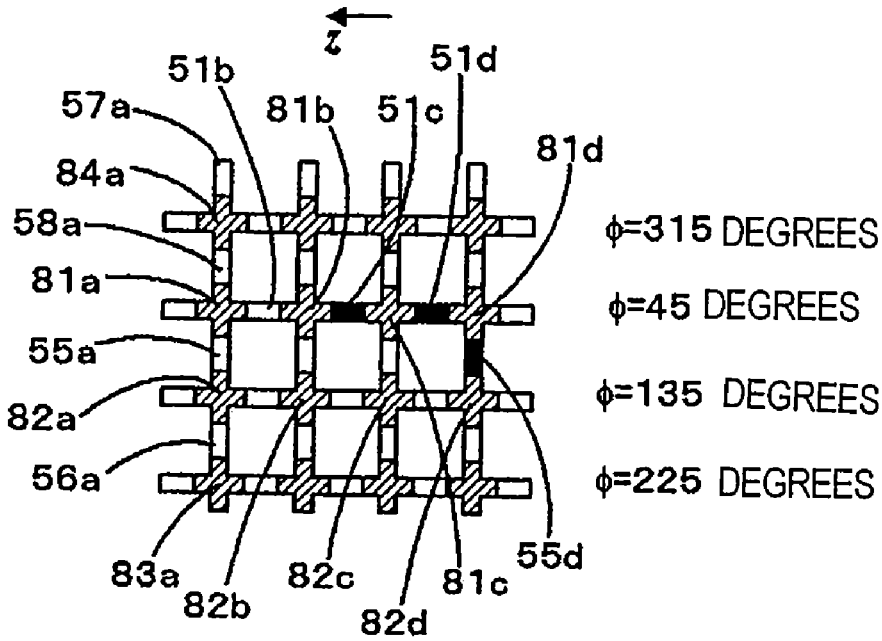
FIG. 7A is a two-dimensional schematic representation illustrating how to connect the passive unit elements of a passive element together and which switches are opened or closed in the variable-directivity antenna of the preferred embodiment shown in FIG. 1.
Figure 7B:
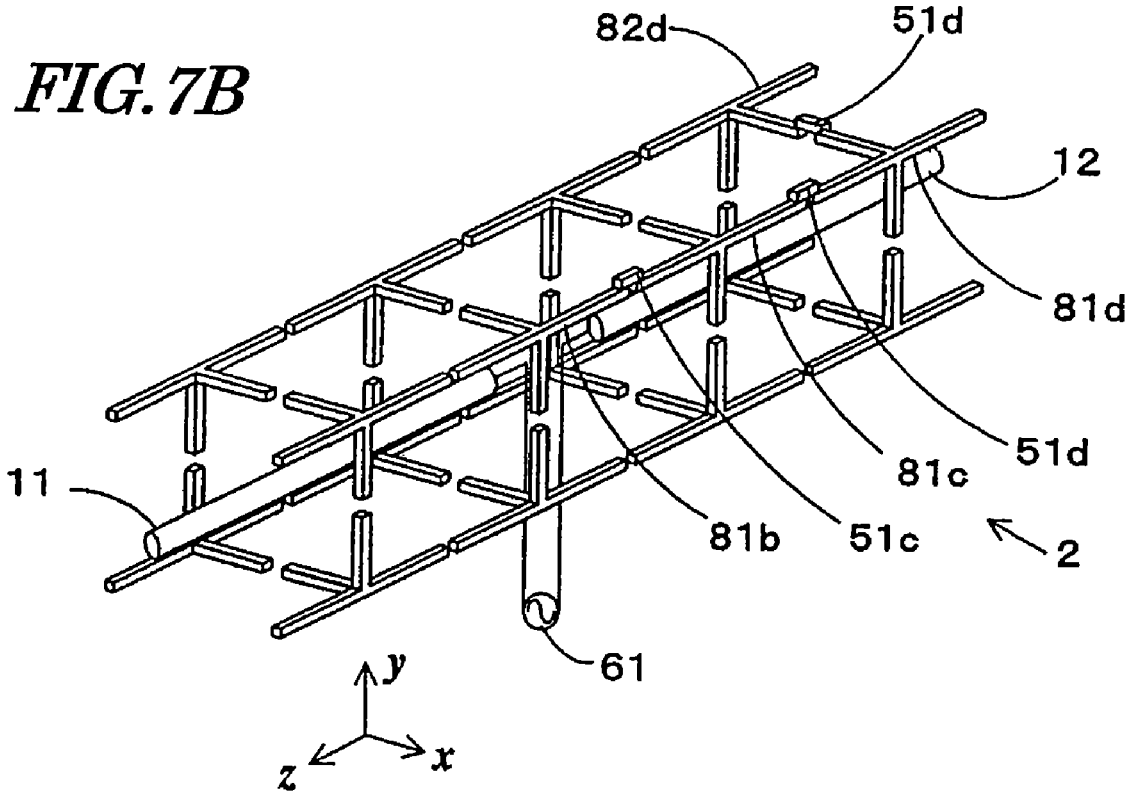
FIG. 7B is a perspective view illustrating an antenna including the passive element shown in FIG. 7A.

Hereinafter, the structure of the passive element assembly 2 of this preferred embodiment will be described with reference to FIGS. 6A, 6B, 7A and 7B. Specifically, FIGS. 6A, 6B and 7B are three-dimensional schematic representations illustrating a principle configuration for the antenna of this preferred embodiment. FIG. 7A is a two-dimensional schematic representation of the structure shown in FIG. 7B.

FIGS. 6A and 7B illustrate equivalently only the shapes of the main conductor portions and switches of the variable-directivity antenna shown in FIG. 1. That is to say, non-essential portions other than minimum required elements for the variable-directivity antenna of this preferred embodiment, such as the dielectric portions of the first and second types of planar substrates 31 and 41 shown in FIG. 1, the conductor patterns 312*b*, etc. shown in FIG. 3B, the feeder lines 62 and 63 shown in FIG. 4 and the control line 710 shown in FIG. 5, are not illustrated in FIGS. 6A and 7B. In other words, the rest is the essential elements that would determine the radiation characteristic of the variable-directivity antenna of this preferred embodiment. Namely, those essential elements of this preferred embodiment include the feed element pair 10, the passive element body 21 consisting of passive elements that run parallel to the feed element pair 10 consisting of the feed elements 11 and 12, the branched element portions 421*a*, etc., which are conductor patterns that are located on multiple planes intersecting with the feed element pair 10 at right angles and that branch from the passive element body 21, and the switches 55*a*, 51*b*, etc.

In these drawings, the passive element body 21, the branched element portions 421 and so on are illustrated as quadrangular prisms and the switches are illustrated as rectangular parallelepiped. Also, the conductor portions that form the passive element body 21 shown in FIG. 6A are obtained by arranging a number of passive unit elements 800 shown in FIG. 6B.

Specifically, the element pieces 211*a* and 211*b* and the L-conductor pattern 42*a* consisting of the branched element portions 421*a* and 422*a* form a passive unit element 81*a*. In the same way, the element pieces 212*a* and 212*b* and the L-conductor pattern 43*a* consisting of the branched element portions 431*a* and 432*a* form another passive unit element 82*a*.

In FIG. 6A, the switches 51*a* through 54*e* mounted on the first type of planar substrates 31*a* and 31*e* at both ends of the variable-directivity antenna shown in FIG. 1 are omitted because those switches cannot change the electrically connected and disconnected states so quickly.

In FIG. 6A, the feed element pair 10 is housed in a "lattice" formed by arranging a plurality of passive unit elements, each of which is electrically equivalent to the passive unit element shown in FIG. 6B, regularly in a predetermined direction. In the passive unit element 800, branched element portions 802 and 803, which are two bar conductors with the same length, are joined together so as to form an angle of 90 degrees between them on a plane that intersects at right angles with an element piece 801, which is as a bar conductor, and with respect to the center of the element piece 801. Each pair of adjacent passive unit elements 800 is connected together with a switch. Thus, by turning the switch, the two adjacent passive unit elements 800 can be selectively electrically connected or disconnected to/from each other.

This structure determines the frequency and radiation directivity of the electromagnetic wave to control. Hereinafter, the shape of such a "lattice" formed by those passive unit elements will be described in further detail.

If the center axis of the feed element pair 10, which consists of two straight or bar conductors, lies on the Z-axis, then the element pieces 211*a* and 211*b* of the passive unit element 81*a* are arranged parallel to the Z-axis, the branched element portion 422*a* thereof parallel to the X-axis, and the branched element portion 421*a* thereof parallel to the Y-axis, respectively. Likewise, as for the passive unit element 82*a*, the element pieces 212*a* and 212*b* are arranged parallel to the Z-axis, the branched element portion 431*a* parallel to the X-axis, and the branched element portion 432*a* parallel to the Y-axis, respectively. In this case, the branched elements (or L-conductors) 422 and 431 are supposed to be located on the same XY plane that intersects with the feed element pair 10 at right angles.

The branched element portions 422*a* and 431*a* are arranged in the same line that is parallel to the X-axis so as to face each other with a certain gap left between them, and are connected to each other with the switch 55*a*. By connecting the branched element portions 421*a*, 422*a*, 431*a* and 432*a* together, a U-connection is formed such that its opening faces the feed element pair 10 (i.e., in the negative Y-axis direction in this case). In the same way, the passive unit elements 83*a* and 84*a* are arranged such that their branched element portions form another U-connection on the same plane that intersects with the feed element pair 10 at right angles and that the opening of the U-connection faces the feed element pair 10 (i.e., in the positive Y-axis direction).

These two U-connections are arranged so as to face each other on the same XY plane and be connected together with switches 56*a* and 58*a*, thereby making those branched element portions form an O-closed loop and arranging the feed element pair 10 inside that closed loop. In this case, when the variable-directivity antenna 1 is viewed perpendicularly to the feed element pair 10, the passive unit elements 81*a* through 84*a* are arranged so as not to stick out of both ends of the feed element pair 10. That is to say, the passive unit elements 81*a* through 84*a* are arranged inside a region defined by two planes that intersect with the feed element pair 10 at right angles and that include one of the two ends of the feed element pair 10 (where its feeding portion is not regarded as its end). Also, the gap between the two branched element portions to be connected with the switch between two adjacent passive unit elements is supposed to be much shorter than the wavelength of electromagnetic waves to radiate.

After that, the other passive unit elements are arranged one after another along the feed element pair 10 in the same direction as the passive unit elements 81*a* through 84*a*, of which the positions and directions have been determined as described above. Specifically, first, the passive unit element 81*b* is arranged such that the passive element body is parallel to the passive unit element 81*a* and that the branched element portions of the passive unit element 81*b* face the same direction as the counterparts of the passive unit element 81*a*. In this case, the element pieces of these two passive unit elements 81*a* and 81*b* are arranged in line and are connected together with the switch 51*b*. Thereafter, two more passive unit elements 81*c* and 81*d* are arranged in this order along the feed element pair 10 and their element pieces are connected together with switches 51*c* and 51*d*.

Subsequently, just like the passive unit elements 81*a* through 84*a*, of which the positions have already been defined, the remaining passive unit elements will be arranged sequentially around these passive unit elements 81*b*, 81*c* and 81*d* such that the four branched element portions of each set of passive unit elements 81*b* through 84*b*, 81*c* through 84*c* and 81*d* through 84*d* form a closed loop around the feed element pair 10.

Moreover, each pair of adjacent branched element portions and each pair of adjacent element pieces are connected together with a switch. Consequently, the antenna thus obtained will have a structure in which the feed element pair 10 runs through the center of a quadrangular prism lattice formed by those groups of passive unit elements.

Also, this variable-directivity antenna 1 is designed such that when the antenna is viewed perpendicularly to the feed element pair 10, no passive unit elements stick out of both ends of the feed element pair 10. That is to say, all passive unit elements are arranged inside a region defined by two planes that intersect with the feed element pair 10 at right angles and that include one of the two ends of the feed element pair 10 (where its feeding portion is not regarded as its end).

In this manner, the antenna shown in FIG. 6, in which the feed elements are inserted into the center of the lattice structure formed by the passive unit elements 81, is obtained.

Hereinafter, it will be described, based on the principle model shown in FIG. 6, what shape and dimensions the passive unit elements should have and how many elements should be arranged. By reflecting the results of the following analysis on the physically implementable model shown in FIG. 1, an antenna that will realize desired characteristics can be designed.

The number of passive unit elements to be arranged around the feed element pair 10 on each plane that intersects with the feed element pair 10 at right angles does not have to be four like the passive unit elements 81*a* through 84*a* shown in FIG. 6A but may also be three or even more than four. For example, by using six passive unit elements, an equilateral hexagonal closed loop may be formed by their branched element portions. In that case, the angle $\alpha$ formed between two adjacent branched element portions may be 120 degrees, instead of 90 degrees as shown in FIG. 6B.

Also, the number of passive unit elements to arrange along the feed element pair 10 does not have to be four like the passive unit elements 81*a* through 81*d* shown in FIG. 6A, but may be either greater or smaller than four. In any case, the length X4 of the element piece 801 of the passive unit element 800 shown in FIG. 6B may be adjusted according to the number of passive unit elements to be arranged in line in the Z-axis direction.

The length X2 of the branched element portions 802 and 803 shown in FIG. 6B needs to be adjusted according to the distance from the center axis of the feed element pair 10 to those of the element pieces 211, 212, 213 and 214 of the passive unit elements 81, 82, 83 and 84 and the number of passive unit elements to be arranged around the feed element pair 10. Although the overall length of each passive element X4×n (where n is the number of the passive unit elements arranged along the feed element pair 10) should be equal to or less than the length of the feed element pair 10, the length X2 of the branched element portions 802 and 803 is not particularly limited. However, if the length X2 of the branched element portions 802 and 803 were greater than the length X4 of the element piece 801 of each passive unit element 800, then the resonant frequency of the passive element would change significantly by turning the switch that connects together the branched element portions, thus making it difficult to control the resonant frequency of the passive element.

On the other hand, the shorter the length X2 of the branched element portions, the more easily the resonant frequency of the passive element to form can be adjusted by turning the switch that connects the branched element portions together. In that case, however, the passive unit elements are located closer to the feed element, and therefore, are electromagnetically coupled to the feed element more strongly. In conclusion, the best way to control the radiation frequency and the directivity easily is to set the length X4 of the element piece 801 of each passive unit element 800 and the length X2 of the branched element portions thereof approximately equal to each other.

If necessary, the passive elements may be arranged at a longer distance from the feed element as long as electromagnetic coupling can still be produced. Nevertheless, the more distant the passive elements are from the feed element, the less effectively the radiation directivity can be controlled at a particular frequency.

In the specific example of the present invention to be described below, the distance from the feed element to the passive elements is defined to be 3.2 mm, which is roughly a twenty-third of a wavelength of 75 mm at a radiation center frequency of 4 GHz. However, the directivity would still change significantly even if the passive elements were arranged at a longer distance from the feed element. To control the radiation directivity effectively enough, the distance from the feed element to the passive elements is preferably approximately equal to or shorter than an eighth of the wavelength of electromagnetic waves to radiate. Meanwhile, to control the frequency of the passive element easily, the length X4 of the element piece of each passive unit element 800 is preferably as short as possible and the number of passive unit elements arranged along the feed element is preferably as large as possible. However, the passive element can be designed by using the branched element portions. Besides, the greater the number of passive unit elements to arrange, the greater the number of switches to provide and the number of control signals to use. For that reason, the length of each element piece should not be decreased too much. Consequently, those parameters should be determined according to how precisely the radiation frequencies need to be changed.

Specifically, if the radiation frequencies need to be changed with a precision of approximately 100 MHz at a center frequency of 4 GHz, then the length of the element piece of each passive unit element may be approximately a twentieth of the wavelength and that of the branched element portions may be approximately a twenty-fourth of the wavelength as in specific examples of the present invention to be described later. Suppose only bar conductors are used as passive elements as in a conventional antenna. In that case, if the passive elements were designed by dividing each of those passive elements into multiple unit elements, each having a length corresponding to a twentieth wavelength, then the resonant frequencies of the passive element could be changed with only a precision of 400 MHz at that center frequency of 4 GHz. According to the present invention, however, the precision of 100 MHz is realized by using the branched element portions.

As for the other frequency ranges, the resonant frequencies of the passive elements can be changed as precisely as in this example by using the branched element portions. That is why by determining the resonant frequency of the passive elements that are formed by selectively electrically connecting or disconnecting the passive unit elements by turning the switches and also determining the positions of the passive elements with respect to the feed element, the radiation directivity at a particular frequency can be controlled by electromagnetically coupling the passive elements to the feed element.

A conventional controllable-directivity antenna often uses straight passive elements that run parallel to the feed element. On the other hand, according to this preferred embodiment, conductor patterns that do not run parallel to the feed element (such as the L-conductor pattern 42*a* consisting of the branched element portions 421*a* and 422*a* shown in FIG. 1) are used as portions of a passive element, thereby electrically connecting the passive unit elements together. If the conventional straight passive elements were used, those passive elements should be shifted to tilt the beam on a vertical plane, which would increase the length of the conventional variable-directivity antenna significantly. In contrast, according to the present invention, the radiation directivities can be changed similarly even without increasing the length of the variable-directivity antenna too much. And the present invention should be effectively applicable to mobile telecommunications terminals that need to have as small a size as possible. In addition, according to the present invention, as long as they fall within the radiation range of the feed element, the frequencies of electromagnetic waves, at which the radiation directivity should be controlled by changing the resonant frequencies of the passive elements, can be appropriately selected and changed.

Hereinafter, it will be described with reference to FIGS. 7A and 7B how to design a passive element that achieves such effects. FIG. 7A illustrates two-dimensionally how to arrange and connect the passive unit elements and switches of the variable-directivity antenna shown in FIG. 6A. In FIG. 7A, the shadowed cross portions represent the passive unit elements. Also, in FIG. 7A, the lateral direction on the paper is the Z-axis direction and the order of arrangement according to the azimuth angle $\phi$ is shown vertically. That is to say, in the cross representing each passive unit element, the two arms extending horizontally correspond to the element piece of the passive unit element and the other two arms extending vertically correspond to the branched element portions. The open rectangles represent opened switches and the solid rectangles represent closed switches.

FIG. 7B is a perspective view illustrating a variable-directivity antenna including the passive unit elements shown in FIG. 7A. In FIG. 7B, only closed switches are illustrated and opened switches are not shown. FIG. 7B illustrates three-dimensionally the positional relation between the feed element pair 10 and the passive element assembly 2 shown in FIG. 7A.

The passive element assembly 2 shown in FIGS. 7A and 7B is formed by closing the switches 51*c*, 51*d* and 55*d* that connect the passive unit elements 81*b*, 81*c*, 81*d* and 82*d* together. This passive element assembly 2 achieves the effect of changing the radiation directivities by being electromagnetically coupled to the feed element pair 10 at a predetermined resonant frequency. More specifically, in the passive element assembly 2, the passive unit elements 81*b*, 81*c* and 81*d* are electrically continuous with each other and the passive element 21*a* formed by arranging their element pieces in line and electrically connecting them together is longer than any other passive element in the passive element assembly 2. That is why the passive element 21*a* is electromagnetically coupled to the feed element pair 10 most strongly. Such a passive element will be referred to herein as a "main axis portion". In that case, the radiation directivities change on a plane that includes the feed element pair 10 and the main axis portion 21*a* of the passive element assembly 2. Also, if the main axis portion 21*a* of the passive element assembly 2 is projected onto an XZ plane, the center of the projected image is located in the negative Z-axis direction with respect to the origin. Thus, as will be described later for specific examples of the present invention, at such frequencies that make the passive element assembly 2 operate as a waveguide, the radiation directivities change in the direction pointing toward the main axis portion 21*a* of the passive element assembly 2 from the center of the feed element pair 10, i.e., at an elevation angle of 90 to 180 degrees.

Likewise, at such frequencies that make the passive element assembly 2 operate as a reflector, the radiation directivities change in the direction pointing away from the main axis portion 21*a* of the passive element assembly 2 toward the center of the feed element pair 10, i.e., at an elevation angle of 0 to 90 degrees.

Furthermore, by closing the switch 55*d* between the branched element portions, the main axis portion 21*a* of the passive element assembly 2 is electrically connected to the passive unit element 82*d*. In such a state, the resonant frequency of the passive element assembly 2 decreases compared to a situation where the passive unit element 82*d* is not electrically continuous with the main axis portion 21*a*.

By adopting such a configuration that has bent portions in the branched element portions, the length of the passive element assembly 2 as measured along the feed element pair 10 can be shortened compared to a situation where only straight conductors with the same resonant frequency are used.

Also, even if the switch 55*d*, etc. that connects its associated branched element portions is not closed but opened, the branched element originally provided for the passive unit element (e.g., the branched element 42*a* for the passive unit element 81*a*) can shorten the length of the passive element assembly 2 more effectively than straight conductors with the same resonant frequency.

Furthermore, by either opening the switch 55*d* with the switch 55*b* closed or opening both of two switches 55*d* and 58*d* at the same time, the resonant frequencies of the passive element assembly 2 can be changed slightly. As a result, the frequencies to control the radiation directivity can be changed.

Figure 17:
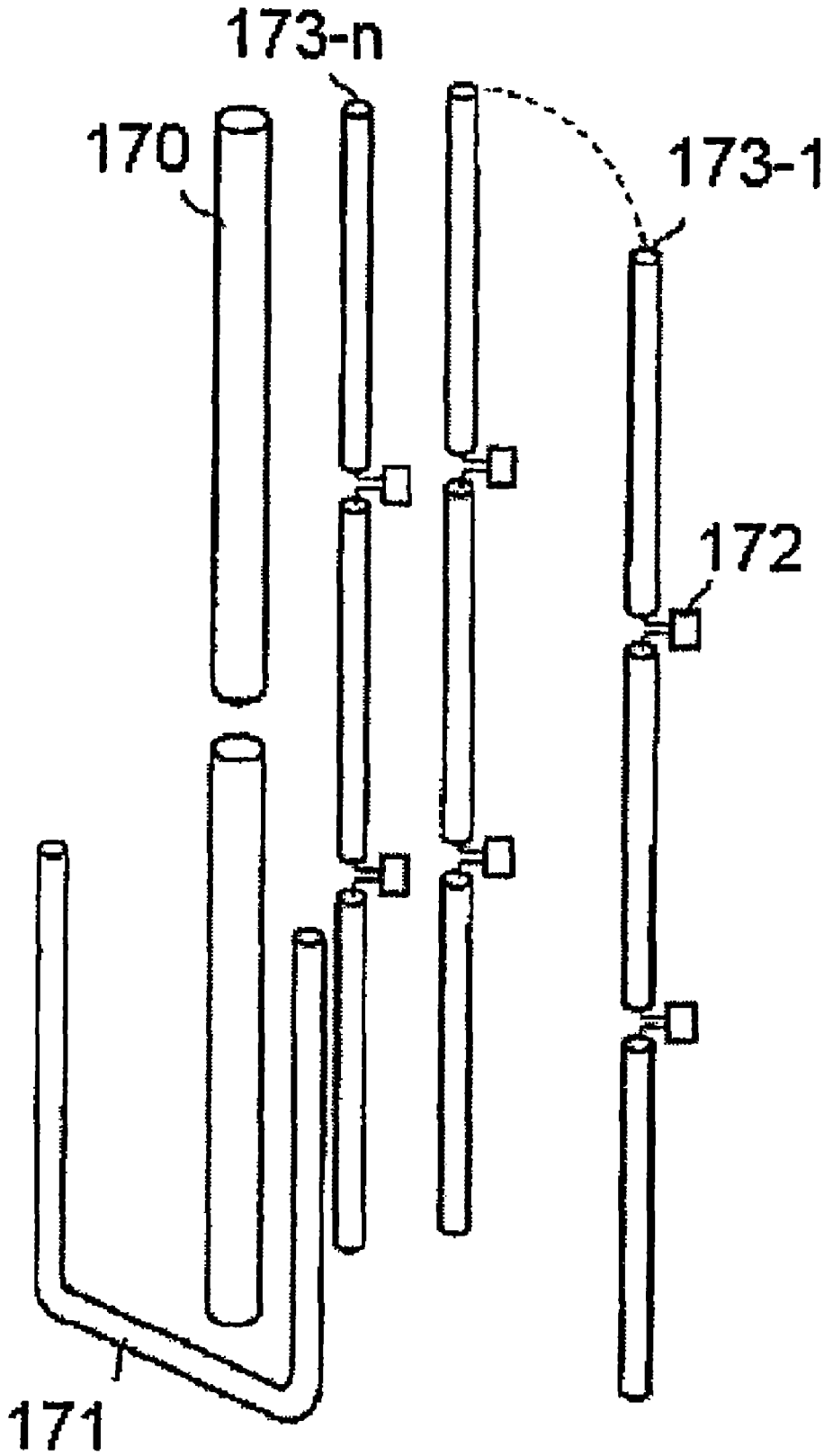
FIG. 17 illustrates a conventional antenna that can change radiation directivities on a vertical plane.
Figure 18A:
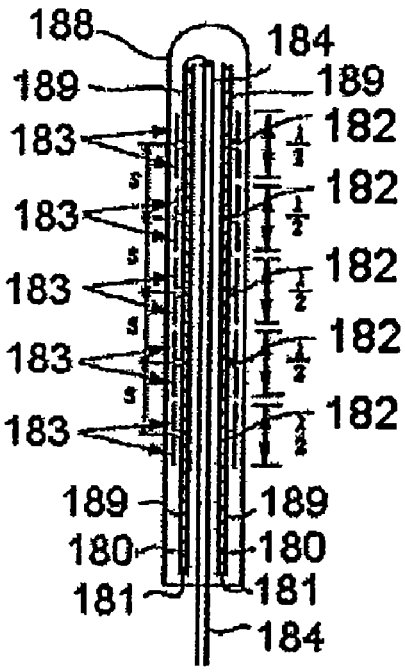
FIGS. 18A through 18C illustrate a conventional collinear array antenna.
Figure 18B:
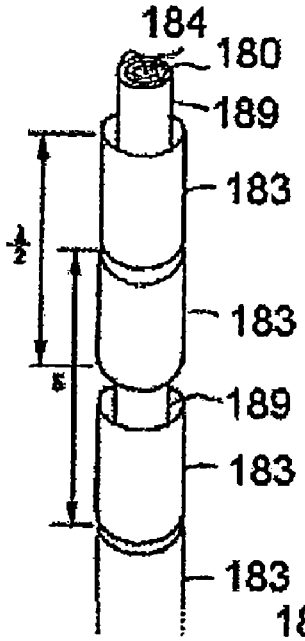
Figure 18C:
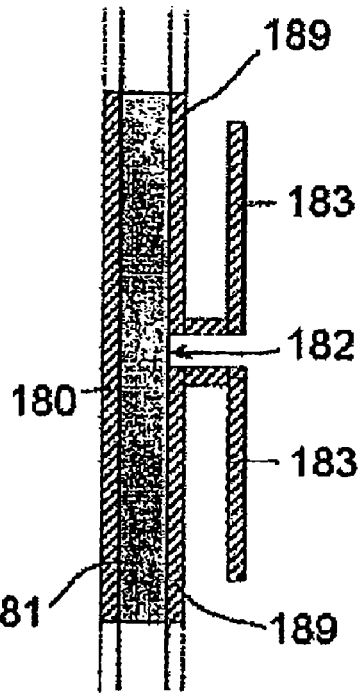

In the conventional antenna shown in FIG. 17, if a passive element were provided as a bar conductor so as to achieve similar frequency selectivity, then the passive element should be divided into a lot of portions along the feed element and a number of switches should be arranged between them.

In a preferred embodiment of the present invention, by using those switches to connect the branched element portions, the passive element needs to be divided a much smaller number of times (i.e., the number of switches to provide can be reduced significantly) to achieve similar frequency selectivity. On top of that, multiple passive elements may be provided as needed. In that case, the radiation directivity can be changed more effectively by using those passive elements in combination.

Examples

Figure 8:
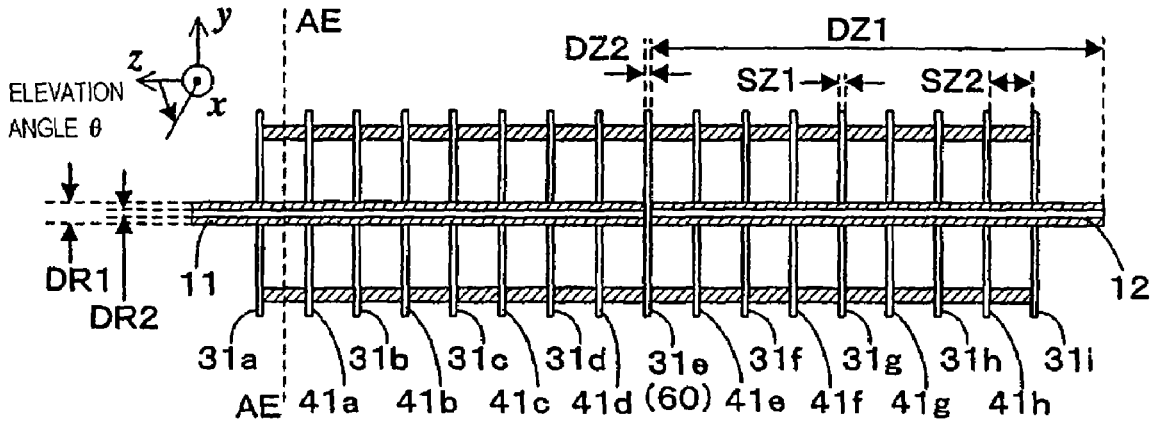
FIG. 8 is a cross-sectional view illustrating a specific example of a variable-directivity antenna according to the present invention as viewed on a YZ plane.

FIG. 8 is a cross-sectional view illustrating a specific example of a variable-directivity antenna according to a preferred embodiment of the present invention as viewed on a plane that includes the center axis of the feed element pair 10. In FIG. 8, the center axis of the feed element pair 10 is defined as the Z-axis and a YZ plane is parallel to the paper.

Planar substrates for use in this antenna are the first and second types of planar substrates 31 and 41, which are arranged alternately. The feed elements 11 and 12 run through the center of the first type of planar substrates 31 (except the planar substrate 31*e*) and the second type of planar substrates 41. That first type of planar substrate 31*e*, which is located at the center of the arrangement of the planar substrates 31 and 41, is designed as a dielectric substrate 60. That is to say, neither the feed element 11 nor the feed element 12 runs through the first type of planar substrate 31*e*, which includes the feeder lines 62 and 63 shown in FIG. 4A. Those feeder lines 62 and 63 are connected to the feed elements 11 and 12 on the two sides of the planar substrate 31*e*.

FIG. 9A is a cross-sectional view of the variable-directivity antenna shown in FIG. 8 as viewed on a plane AE that intersects with the Z-axis at right angles. FIG. 9B is a plan view illustrating one side of the second type of planar substrate 41 that faces the positive Z-axis direction. FIG. 9C is a plan view illustrating one side of the first type of planar substrate 31 that faces the positive Z-axis direction. FIG. 9D is a plan view illustrating the other side of the first type of planar substrate 31 that faces the negative Z-axis direction. And FIG. 9E is a plan view illustrating one side of the first type of planar substrate 31*e*, functioning as the dielectric substrate 60, in the positive Z-axis direction.

The feed element pair 10 consists of feed elements 11 and 12, which are two hollow cylindrical conductors and which are supposed to face each other symmetrically on the Z-axis with respect to the origin. The feed elements 11 and 12 have a length DZ1 of 5.0 mm, an outside diameter DR1 of 0.6 mm, an inside diameter DR2 of 0.3 mm, and a gap DZ2 that is equal to the thickness SZ1 of the planar substrates 31 and 41 of the first and second types. That is to say, DZ2=SZ1=0.3 mm is satisfied. The interval SZ2 between the first and second types of planar substrates 31 and 41 is 1.5 mm.

As shown in FIG. 8, each passive unit element, including a passive element and branched element portions, is interposed between two planes, which intersect with the feed element pair 10 at right angles and which include one of the two ends of the feed elements 11 and 12. For that reason, when measured along the feed element pair, the overall length of the passive element body to be formed when all of the switches between their element pieces are closed (which is approximately equal to the distance between the first type of planar substrates 31*a* and 31*i* according to the design illustrated in FIG. 8) is never greater than that of the feed element pair (which is approximately twice as large as the length DZ1 of each feed element). It should be noted that the center of the passive element body to be formed when all of the switches between their passive unit elements are closed agrees with that of the feed element pair, which is located at the origin.

Next, the positional relation between the feed element 11 and the element pieces 211*a* through 214*a* of the passive unit element on a cross section that intersects with the feed element pair 10 at right angles will be described with reference to FIG. 9A.

In this arrangement, the center of the feed element 11 is located at the center of the square that is formed by connecting together the respective centers of the element pieces 211*a* through 214*a*. Supposing the center of the feed element 11 is the origin of coordinates, the respective centers of those parallel element pieces 211*a* through 214*a* of the passive unit element will have their XY coordinates represented as (±PDX1, ±PDY1) on the plane AE shown in FIG. 8. In this example, PDX1=PDY1=2.5 mm and the radius PR1 of the passive unit element is 0.2 mm.

Next, the shapes of the conductor patterns for the first and second types of planar substrates 31 and 41 will be described with reference to FIGS. 9B through 9E.

Each planar substrate 41 of the second type has a square planar shape and has dimensions satisfying SX1=SY1=5.8 mm as shown in FIG. 9B. As for each planar substrate 31 of the first type, SX2=SY2=5.8 mm is also satisfied as shown in FIG. 9C. FIG. 9B is a plan view illustrating one side of the second type of planar substrate 41 that faces the positive Z-axis direction. The branched element portions 42 to 45 that are L-conductor patterns on the second type of planar substrate 41 have a length that satisfies PAY1=PAX1=2.5 mm as measured in the longitudinal direction. The gap between adjacent conductor patterns satisfies PAY2=PAX2=0.4 mm and the pattern widths satisfy PAY3=PAX3=0.4 mm. That is to say, as can be seen from FIGS. 9A and 9B, the second type of planar substrate 41 can be connected to the passive unit element in the vicinity of the respective bent portions of the L-conductor patterns of the branched element portions 42 through 45 shown in FIG. 9B.

FIG. 9C is a plan view illustrating one side of the first type of planar substrate 31 that faces the positive Z-axis direction. In the first type of planar substrate 31, the conductor patterns 321, 331, 341 and 351 that are connected to the passive element body 21 on that side facing the positive Z-axis direction satisfy PBX1=PBY1=1.5 mm, PBX2=PBY2=1.2 mm and PBY3=PBX3=0.4 mm (were PBX3 and PBY3 represent the width of the conductor patterns). As a result, those series of conductor patterns and the passive element body are connected together as shown in FIG. 3B. Also, the other patterns 322, etc. to be connected to the switches satisfy PBY4=PBY5=PBX4=PBX5=0.4 mm.

FIG. 9D is a plan view illustrating the other side of the first type of planar substrate 31 that faces the negative Z-axis direction. In the first type of planar substrate 31, the conductor patterns 323, 333, 343 and 353 that are connected to not only the passive element body 21 on that side facing the negative Z-axis direction but also to the switch connecting conductor patterns 322, etc. on that side facing the positive Z-axis direction through the via holes 324, etc. shown in FIG. 3B satisfy PBX6=PBY6=2.7 mm, PBX7=0.4 mm and PBY7=1.2 mm.

FIG. 9E is a plan view illustrating one side of the first type of planar substrate 31*e*, functioning as the dielectric substrate 60, in the positive Z-axis direction. Unlike the other planar substrates 31 of the first type, a circular electrode 622, having the same size as the diameter of the feed element pair 10, is arranged at the center of this planar substrate 31*e* and a feeder line 62 is arranged as a strip conductor pattern so as to run from the electrode 622 through the edge of the substrate.

On the back surface of this substrate, a circular electrode 632 is also arranged at the center of the substrate and a feeder line 63 is also arranged as a strip conductor pattern so as to run from the electrode 622 through the edge of the substrate. Thus, by supplying a radiation signal between the feeder lines 62 and 63 at the edge of the substrate, the signal will propagate through the feeder lines 62 and 63 in a parallel plate mode and then will be input to the feed element pair 10 through the electrodes 622 and 632.

Hereinafter, an exemplary design for the passive element assembly and the typical radiation directivity thereof will be described.

FIG. 11 illustrates how passive unit elements may be arranged and how those elements are designed so as to be electrically continuous or discontinuous to/from each other following the pattern shown in FIG. 7. In FIG. 11, the shadowed crosses represent the passive unit elements as in FIG. 7. Also, in FIG. 11, the lateral direction on the paper is the Z-axis direction and the order of arrangement according to the azimuth angle $\phi$ is shown vertically. That is to say, in the cross representing each passive unit element, the two arms extending horizontally correspond to the element piece of the passive unit element and the other two arms extending vertically correspond to the branched element portions. Furthermore, in the rectangles that connect adjacent passive unit elements together, the open rectangles represent opened switches and the solid rectangles represent closed switches.

As shown in FIG. 8, in this specific example, eight passive unit elements, each having an electrically equivalent shape as the passive unit element 800 shown in FIG. 6B, are arranged parallel to the feed element pair 10. Also, on a plane that intersects with the feed element pair 10 at right angles, four passive unit elements surround the feed element pair with their branched element portions arranged close to each other as in the example shown in FIG. 6A. In this case, the element piece of each of those four passive unit elements is arranged so as to define an azimuth angle ϕ of 45, 135, 225 or 315 degrees with respect to the feed element pair.

Figure 11A:
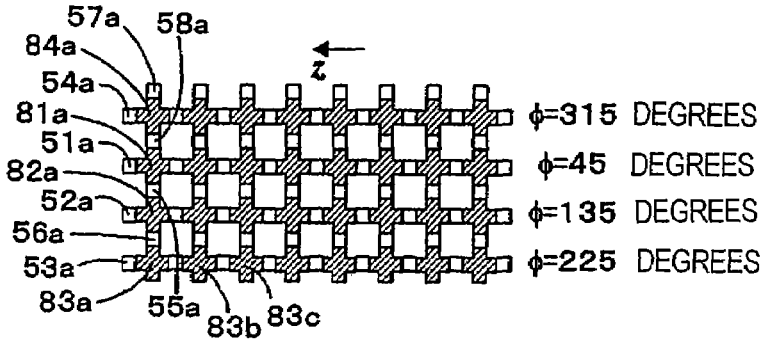
FIGS. 11A through 11D are two-dimensional schematic representations illustrating how passive unit elements may be arranged and which switches need to be opened or closed in the specific example of the variable-directivity antenna of the present invention.
Figure 11B:
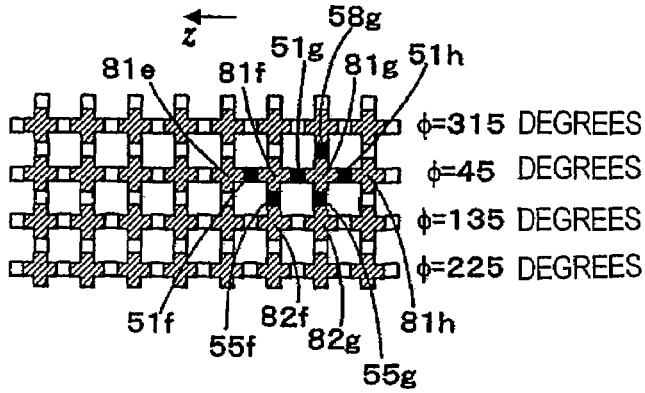

FIG. 11A illustrates a situation where all of the switches are opened. On the other hand, FIG. 11B illustrates a situation where passive unit elements 81*e*, 81*f*, 81*g*, 81*h*, 82*f*, 82*g*, and 84*g* are electrically continuous with each other by closing their switches 51*f*, 51*g*, 51*h*, 55*f*, 55*g* and 58*g*. The same goes for FIGS. 11C and 11D.

In the sample models to be described below, the switches are supposed to be opened as in the conductor patterns shown in FIG. 9 and also supposed to be closed by extending those conductor patterns with their width (or cross-sectional area) maintained.

Figure 10:
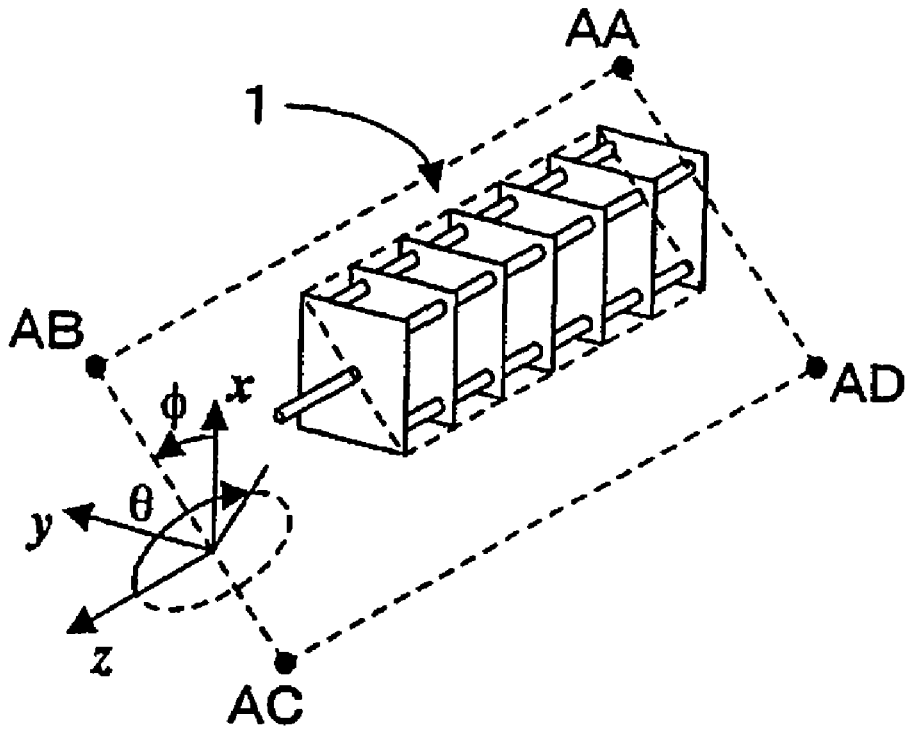
FIG. 10 is a schematic representation illustrating a relation between a variable-directivity antenna as the preferred embodiment of the present invention and a vertical plane defined by a predetermined azimuth angle.
Figure 11C:
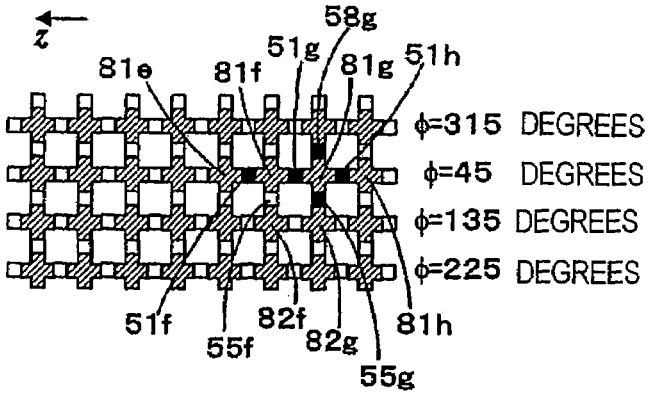

As already described, in the exemplary design shown in FIGS. 11B and 11C, a number of passive unit elements 81*e* through 81*h*, which are arranged in line parallel to the feed elements, are electrically continuous with each other. As a result, the main axis portion 21*a* of the passive element body formed by those passive unit elements has significant influence on the variation in radiation directivity. That is to say, the radiation directivity varies on, and the main beam is directed to, a vertical plane, which is defined by an azimuth angle of 45 degrees and which is a plane including the feed element pair 10 and the main axis portion 21*a* of the passive element body. Such a vertical plane defined by the azimuth angle of 45 degrees is formed by connecting together the points AA-AB-AC-AD shown in FIG. 10.

Figure 11D:
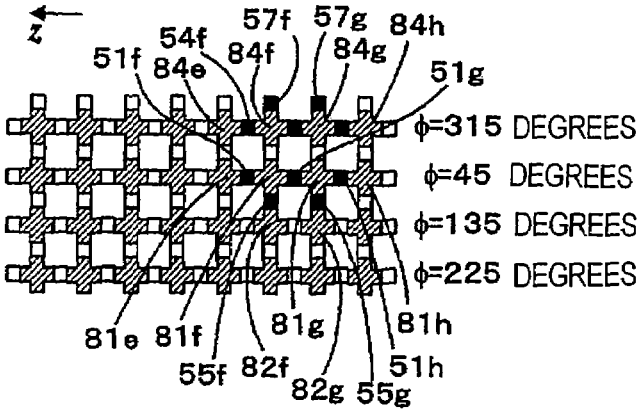
Figure 14:
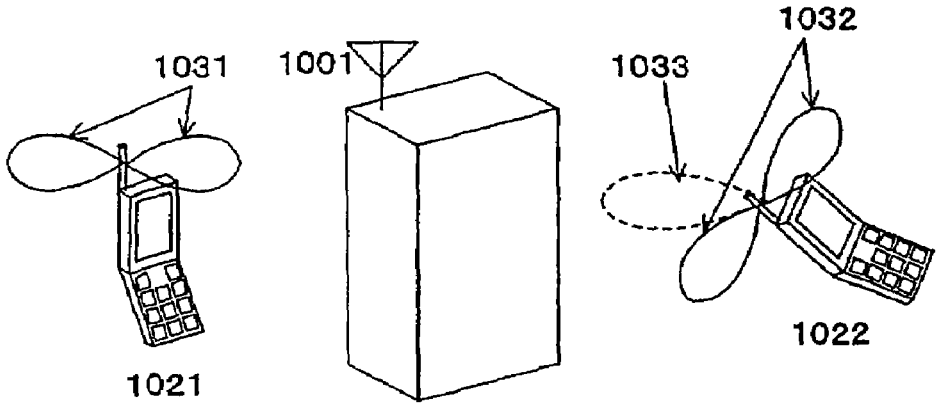
FIG. 14 is a schematic representation illustrating what problems a linear antenna would cause when a cellphone is used as an information receiver-transmitter.

On the other hand, in the example illustrated in FIG. 11D, the passive element 21*a* located at an azimuth angle of 45 degrees leading to the passive unit elements 81*e*, 81*f*, 81*g* and 81*h* and the passive element 21*d* located at an azimuth angle of 315 degrees leading to the passive unit elements 84*e*, 84*f*, 84*g* and 84*h* have the same length that is greater than any other passive element. That is why both of these passive elements 21*a* and 21*d* function as main axis portions. In this exemplary design, at a predetermined frequency of 4.3 GHz, the two passive elements have the same shape and function as equivalent reflectors. As a result, the radiation directivity varies on a vertical plane that is defined by an azimuth angle of 0 degrees and that is located at the same distance from the main axis portions 21*a* and 21*d* of the passive elements.

FIGS. 12A through 12D show radiation directivity gains on vertical planes that are used to design the passive element assembly shown in FIGS. 11A through 11D, respectively. FIGS. 12A through 12D correspond to the exemplary connections shown in FIGS. 11A through 11D, respectively. Specifically, FIGS. 12A through 12C show radiation directivity gains on a vertical plane defined by an azimuth angle of 45 degrees, while FIG. 12D shows a radiation directivity gain on a vertical plane defined by an azimuth angle of 0 degrees.

FIG. 12A shows the results of measurements at a frequency of 4.1 GHz. As this is a radiation directivity gain on a vertical plane, directivities are produced at elevation angles of 90 degrees and 270 degrees, which is quite natural for a half-wave dipole antenna.

FIG. 12B shows the results of measurements at a frequency of 4.4 GHz, while FIG. 12C shows the results of measurements at a frequency of 3.7 GHz. On a vertical plane, which is defined by an azimuth angle of 45 degrees and on which the main axis portion of the passive element body is defined, the radiation directivity varied toward the center of the main axis of the passive element body, formed by the passive unit elements, as viewed from the feeding point (i.e., origin) located at the center of the feed element pair 10 (i.e., from the direction defined by an elevation angle of 90 degrees into the one defined by an elevation angle of 180 degrees). The radiation directivity varied by 30 degrees in FIG. 12B and by 20 degrees in FIG. 12C, respectively.

In FIG. 12D, on a vertical plane defined by an azimuth angle of 0 degrees, which is located at the same distance from the respective main axis portions of two passive element bodies, the radiation directivity varied by 30 degrees at a frequency of 4.3 GHz in the direction opposite to the passive elements (i.e., from the direction defined by an elevation angle of 270 degrees into the direction defined by an elevation angle of 0 degrees).

Consequently, according to the results shown in FIGS. 12B and 12C, the passive elements functioned as a waveguide and the radiation directivity varied toward the passive elements as viewed from the center of the feed element. On the other hand, according to the results shown in FIG. 12D, the two passive elements functioned as reflectors, and therefore, the radiation directivity varied away from the passive elements as viewed from the center of the feed element.

FIGS. 12A through 12D show the results of measurements that were carried out at mutually different frequencies. For that reason, to realize such variations, the resonant frequency of the passive elements should be controlled. To achieve this purpose, it is effective to design the passive elements by not just adjusting the length of the main axis portion of the passive element body but also using the branched element portions as well.

In the arrangements shown in FIGS. 11A through 11D, the main axis portion of the passive element body has substantially the same configuration but their shapes are designed differently using the branched element portions, thereby enabling the control of the resonant frequency of the passive elements.

If such a precise control of the resonant frequency of the passive elements were performed on the straight passive element that has been divided into multiple stages as shown in FIG. 17, then the straight passive element should be divided into a huge number of stages. In contrast, if the branched element portions are used as in the present invention, then the resonant frequencies can be changed easily by selecting appropriate positions to make those branched element portions electrically continuous. As a result, not just the direction to vary the radiation directivity but also the frequency of the electromagnetic waves can be designed as shown in FIGS. 11 and 12.

Last but not least, the design concept and background of the passive element will be described.

The passive element is fed with electrical power and produces radiation when electromagnetically coupled to the feed element pair 10. For that reason, the passive element needs to not only be arranged somewhat close to the feed element pair 10 but also include a conductor portion in which current can flow in the direction of the electric field radiated by the feed element pair 10.

Since current flows through the feed element pair 10 in the Z-axis direction, the electric field direction of the electromagnetic field radiated has only components that are included within a plane including the Z-axis (and intersecting with the XY plane at right angles). That is why the (linear) conductors that are parallel to the XY plane are not coupled to the feed element pair 10. In general, such an arrangement that will contribute to electromagnetically coupling the feed element pair 10 and the passive elements together strongly is preferably selected and the passive elements are supposed to be arranged parallel to the feed elements as shown in FIGS. 16 and 17.

As already described, however, if the passive elements were arranged as linear conductors parallel to the feed element, then the passive elements, functioning as either a waveguide or a reflector, should be shifted parallel to the feed element (i.e., in the Z-axis direction) in order to change the radiation directivities within a vertical plane. In that case, the resonant frequency (corresponding to the length) of the passive elements would be substantially equal to that of the feed element. That is why it is clear that the passive elements should stick out of the ends of the feed element by the magnitude of that shift, thus increasing the overall length of the antenna.

The passive element does not have to consist of only conductors that run parallel to the feed element. But a portion of the passive element may branch perpendicularly from a conductor portion running parallel to the feed element. In addition, by adopting such a shape, the resonant frequency of the passive element can be decreased, which in turn makes it possible to shorten the length of the passive element as measured parallel to the feed element. As a result, a dipole antenna that varies the radiation directivity within a vertical plane can be designed without increasing its length in the longitudinal (or major-axis) direction.

Figure 15:
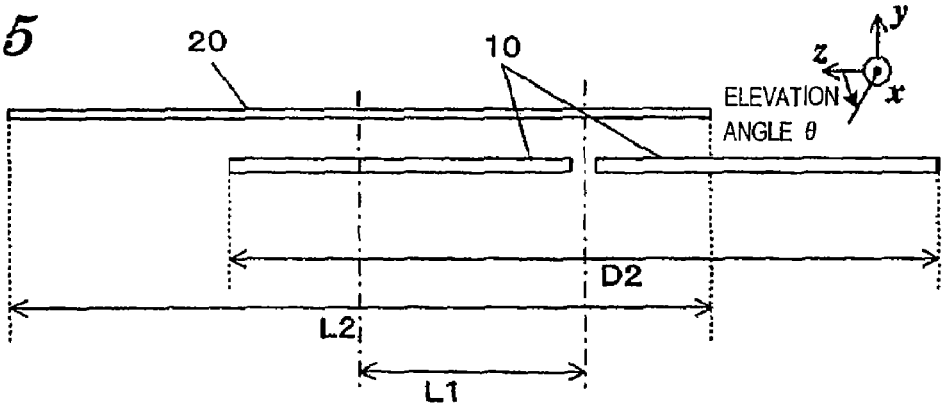
FIG. 15 is a plan view illustrating a conventional antenna assembly that uses a linear passive element.

To change significantly the radiation directivities of a linear antenna such as a dipole antenna within a vertical plane (i.e., a plane including the feed element) using the conventional straight passive elements, the passive element 20 should be shifted in the longitudinal direction with respect to the feed element 10 as shown in FIG. 15. As a result, the antenna assembly should have its overall length increased by the magnitude of that shift.

According to the present invention, however, the passive element is designed using the branched element portions, thereby shortening the length of the passive element in the longitudinal direction thereof. Consequently, as shown in FIGS. 12B through 12D, the radiation directivities can be changed significantly without allowing the passive elements to stick out of the feed element in the longitudinal direction as can be seen easily from FIG. 8.

A variable-directivity antenna according to the present invention can change the radiation directivities of a linear antenna such as a dipole antenna both within a plane including a feed element and within a plane that intersects with the feed element at right angles. Thus, by controlling the radiation directivity toward the target with the reception of disturbance waves suppressed, the present invention can improve the quality of telecommunications. In addition, since the present invention can prevent the antenna from increasing its length too much in its longitudinal direction, it can be used particularly effectively to make mobile or indoor telecommunications terminals.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

What is claimed is:

1. A variable-directivity antenna comprising feed elements, which are implemented as linear conductors running parallel to a Z-axis, and a passive element assembly, wherein the passive element assembly includes a number n (where n is a natural number that is equal to or greater than three) of linear passive elements that also run parallel to the Z-axis so as to surround the feed elements, and wherein each said passive element includes:

a plurality of element pieces that are arranged parallel to the Z-axis; and at least one switching element of a first type that electrically connects selected ones of the element pieces to each other, and wherein the passive element assembly further includes at least one switching element of a second type that electrically connects two adjacent ones of the n passive elements to each other when turned ON but electrically disconnects the two adjacent passive elements from each other when turned OFF, and wherein the variable-directivity antenna changes its directivities by turning ON and OFF the at least one switching element of the first type and the at least one switching element of the second type, and wherein the switching elements of the first type are arranged on a first type of planar substrates, and wherein the switching elements of the second type are arranged on a second type of planar substrates, and wherein the element pieces are interposed between the first and second types of planar substrates, and wherein the feed elements run through respective through holes of the first type of planar substrates and respective through holes of the second type of planar substrates.

2. The variable-directivity antenna of claim 1, wherein a distance from the passive elements to the feed elements is equal to or shorter than one quarter of the wavelength of electromagnetic waves to radiate.

3. The variable-directivity antenna of claim 1, wherein each said passive element is shorter in length than the feed elements.

4. The variable-directivity antenna of claim 1, wherein the passive element assembly further includes the planar substrates on which the switching element(s) of the first type and/or the switching element(s) of the second type are/is mounted, and wherein the planar substrates are held by the feed elements.

5. The variable-directivity antenna of claim 1, further comprising a feeding planar substrate on which feeder lines that are electrically connected to the feed elements are arranged.

6. The variable-directivity antenna of claim 5, wherein the feeder lines are electrically connected to a transceiver (61).

7. The variable-directivity antenna of claim 5, wherein the switching element(s) of the first type is/are arranged on the feeding planar substrate.

8. The variable-directivity antenna of claim 5, wherein the switching element(s) of the second type is/are arranged on the feeding planar substrate.

9. The variable-directivity antenna of claim 5, wherein a stub is provided for the feeder lines.

10. The variable-directivity antenna of claim 5, wherein the feeding planar substrate has no through hole to pass the feed elements.

11. The variable-directivity antenna of claim 5, wherein the feed elements stick out through the through holes of two planar substrates that are most distant from the feeding planar substrate among the first and second types of planar substrates.

12. The variable-directivity antenna of claim 1, wherein the feed elements are longer than any of the passive elements as measured along the Z-axis.

* * * * *

UNITED STATES PATENT AND TRADEMARK OFFICE

CERTIFICATE OF CORRECTION

PATENT NO. : 7,482,993 B2
APPLICATION NO. : 12/143424
DATED : January 27, 2009
INVENTOR(S) : Tomoyasu Fujishima et al.

It is certified that error appears in the above-identified patent and that said Letters Patent is hereby corrected as shown below:

On the title page, below the data for Item "(63)" and before Item "(51)", insert the following:

Item -- (30) Foreign Application Priority Data

Dec. 21, 2005 (JP).....2005-367695 --.

Signed and Sealed this

Ninth Day of June, 2009

John Doll

JOHN DOLL
*Acting Director of the United States Patent and Trademark Office*